US008659612B2

(12) United States Patent
Yamada

(10) Patent No.: US 8,659,612 B2
(45) Date of Patent: Feb. 25, 2014

(54) CONTROL DEVICE, DISPLAY DEVICE AND METHOD FOR CONTROLLING DISPLAY DEVICE

(75) Inventor: Yusuke Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 214 days.

(21) Appl. No.: 13/218,967

(22) Filed: Aug. 26, 2011

(65) Prior Publication Data

US 2012/0062579 A1 Mar. 15, 2012

(30) Foreign Application Priority Data

Sep. 10, 2010 (JP) ..... 2010-203619

(51) Int. Cl.
*G09G 5/36* (2006.01)

(52) U.S. Cl.
USPC ..... 345/560; 345/214; 345/556

(58) Field of Classification Search
None
See application file for complete search history.

(56) References Cited

U.S. PATENT DOCUMENTS

2009/0189848 A1* 7/2009 Maeda ..... 345/107
2009/0256798 A1 10/2009 Low et al.
2010/0245338 A1* 9/2010 Todorovich ..... 345/214
2011/0001748 A1 1/2011 Rutman et al.

FOREIGN PATENT DOCUMENTS

JP 2009-251615 A 10/2009

* cited by examiner

*Primary Examiner* — Xiao M. Wu
*Assistant Examiner* — Steven Elbinger
(74) *Attorney, Agent, or Firm* — ALG Intellectual Property, LLC

(57) ABSTRACT

A display device changes the gradation of pixels by a write operation of applying a voltage to the pixels a plurality of times. When newly changing the display state of pixels, the display device judges as to whether or not the pixels whose display state are to be changed are in a write operation. The display device starts the writing operation for those of the pixels that are not in a writing operation, and starts a new writing operation for those of the pixels that are in a writing operation, after the ongoing writing operation is completed. If a writing operation for pixels in progress of being updated and pixels with which a writing operation is to be newly started would lead to substantially large power consumption, the start of the writing operation for the pixels with which a writing operation is to be newly started is postponed.

6 Claims, 31 Drawing Sheets

CONTROL DEVICE, DISPLAY DEVICE AND METHOD FOR CONTROLLING DISPLAY DEVICE

BACKGROUND

1. Technical Field

The present invention relates to control devices, display devices and methods for controlling a display device.

2. Related Art

As display devices for displaying images, electrophoretic type display devices using microcapsules are known. Those of active matrix type among the display devices are provided with a plurality of scanning lines extending in a row direction, a plurality of data lines extending in a column direction, and driving circuits for driving the microcapsules provided respectively at intersections between the scanning lines and the data lines. Upon application of a voltage to the scanning lines and the data lines, a potential difference is generated between electrodes provided on the driving circuits and counter electrodes disposed opposite to the electrodes through the microcapsules. As the potential difference is generated between the electrodes opposite to one another through the microcapsules, white particles and black particles within the microcapsules migrate according to the electric field caused by the potential difference. As the optical reflection characteristic changes due to changes in distribution of the white particles and the black particles within each of the microcapsules, images are displayed.

In some of the electrophoretic type display devices, at the time of changing a display image with the active matrix system, rewriting of the image may require multiple frames. However, if the image rewiring is started over the entire area when the image is rewritten across multiple frames, new data cannot be written until after the current writing is completed, such that addition or deletion of an image needs to be started after the image writing is once completed, which is time consuming and is therefore problematical in view of the operability. In order to address such a problem, JP-A-2009-251615 describes a system that executes rewriting by performing pipeline processing in the unit of a partial region. According to the system described in JP-A-2009-251615, an image is written in two partial regions that do not mutually overlap each other on the screen at timings shifted from one another. Even writing of one of the partial regions in which writing started earlier has not been completed, it is possible to start writing of the other partial region in which writing is to be started later, which results in an improved display speed, compared to other devices that do not use the system described above.

Incidentally, in the active matrix system, data lines function as capacitors due to their parasitic capacitances. Therefore, when the display operation requires a change in voltage on the data lines each time the scanning lines are selected, such a display operation leads to large power consumption. Therefore, when scanning operations with such large power consumption continue at the time of rewriting images, the power consumption may momentarily exceed the power supply limit of the power supply circuit. Further, in the active matrix system, driving circuits to provide currents increase as the display resolution is increased, which leads to greater power consumption.

SUMMARY

In accordance with an advantage of some aspects of the invention, an apparently higher display speed of a display device and a reduction in the peak value of power consumption can both be achieved.

A control device for a display device in accordance with an embodiment of the invention pertains to a control device for a display device that includes pixels in a plurality of rows and a plurality of columns, a first substrate having first electrodes each provided for each of the pixels, a second substrate having a second electrode, and display elements sandwiched between the first substrate and the second substrate, each of the pixels being comprised of the first electrode, the display element and the second electrode, and changes the display state of the pixel from a first display state to a second display state by a write operation of applying a voltage to the display element a plurality of times. The control device includes a selection section that sequentially selects the rows, a data read section that reads image data of an image to be displayed on the display device from a memory, a specifying section that specifies, based on scheduled image data representative of an image scheduled to be displayed on the display device before the data read section reads image data and the image data read by the data read section, changing pixels whose display state is to be newly changed among pixels in a row selected by the selection section, a boundary specifying section that specifies pixels among the pixels in the row selected by the selection section which are to be impressed with a voltage different from a voltage applied to pixels in an adjacent row, and specifies boundaries between the specified pixels and the pixels in the row adjacent to the specified pixels which are impressed with a voltage different from a voltage applied to the specified pixels, a boundary number memory section that stores a boundary number of the boundaries specified by the boundary specifying section at each of the rows, a judging section that judges as to whether or not the sum of the boundary numbers stored in the boundary number memory section is equal to or greater than a predetermined threshold value, and an update section that, when the judging section judges that the sum is less than the predetermined threshold value, starts the write operation with respect to the changing pixels to be changed to a display state defined by the image data if the changing pixels in the row selected by the selection section are not in the write operation, and starts the write operation with respect to the changing pixels to be changed to the display state defined by the image data after the ongoing write operation is finished if the changing pixels are in the write operation, and that, when the judging section judges that the sum is equal to or greater than the predetermined threshold value, does not start the write operation with respect to the changing pixels until the judging section judges that the sum is less than the threshold value. According to the control device described above, the display device can achieve both an apparently higher display speed that can actually be perceived and a reduction in the peak value of power consumption.

In the control device described above, the pixels in a plurality of rows and a plurality of columns may be divided into a plurality of regions each having a predetermined number of rows, and the judging section may be configured to judge as to whether or not the sum of the boundary numbers concerning the region including the row selected by the selection section is equal to or greater than the predetermined threshold value. According to this configuration, the start of the pixel writing operation is controlled for each of the display regions, such that the pixel writing operation can be started in a row that is selected later.

Also, the control device described above may be configured such that voltages are applied to the pixels according to a table that sets voltages to be applied in each of the plurality of times of voltage application. According to such a configuration, the pixel gradation can be changed at each of the pixels.

Also, the control device described above may be configured to control the voltage application timing such that a pixel among the pixels in the row selected by the selection section with which the writing operation is in progress is impressed with the same voltage as the voltage applied to a pixel in an adjacent row with which the writing operation is in progress. According to this configuration, pixels that are impressed with a voltage are impressed with the same voltage applied to the adjacent pixels, such that the power consumption can be suppressed.

A display device in accordance with an embodiment of the invention pertains to a display device that includes pixels in a plurality of rows and a plurality of columns, a first substrate having first electrodes each provided for each of the pixels, a second substrate having a second electrode, and display elements sandwiched between the first substrate and the second substrate, each of the pixels comprised of the first electrode, the display element and the second electrode, and changes the display state of the pixel from a first display state to a second display state by a write operation of applying a voltage to the display element a plurality of times. The display device includes a selection section that sequentially selects the rows, a data read section that reads image data of an image to be displayed on the display device from a memory, a specifying section that specifies, based on scheduled image data representative of an image scheduled to be displayed on the display device before the data read section reads image data and the image data read by the data read section, changing pixels whose display state is to be newly changed among pixels in a row selected by the selection section, a boundary specifying section that specifies a pixel among the pixels in the row selected by the selection section which is to be impressed with a voltage different from a voltage applied to a pixel in an adjacent row, and specifies boundaries between the specified pixels and the pixels in the row adjacent to the specified pixels which are impressed with a voltage different from a voltage applied to the specified pixels, a boundary number memory section that stores a boundary number of the boundaries specified by the boundary specifying section at each of the rows, a judging section that judges as to whether or not the sum of the boundary numbers stored in the boundary number memory section is equal to or greater than a predetermined threshold value, and an update section that, when the judging section judges that the sum is less than the predetermined threshold value, starts the write operation with respect to the changing pixels to be changed to a display state defined by the image data if the changing pixels in the row selected by the selection section are not in the write operation, and starts the write operation with respect to the changing pixels to be changed to the display state defined by the image data after the ongoing write operation is finished if the changing pixels are in the write operation, and that, when the judging section judges that the sum is equal to or greater than the predetermined threshold value, does not start the write operation with respect to the changing pixels until the judging section judges that the sum is less than the threshold value. According to the control device described above, the display device can achieve both a higher display speed that can actually be perceived and a reduction in the peak value of power consumption.

A method for controlling a display device in accordance with an embodiment of the invention pertains to a method for controlling a display device that includes pixels in a plurality of rows and a plurality of columns, a first substrate having first electrodes each provided for each of the pixels, a second substrate having a second electrode, and display elements held between the first substrate and the second substrate, each of the pixels being comprised of the first electrode, the display element and the second electrode, and the method includes changing the display state of the pixel from a first display state to a second display state by a write operation of applying a voltage to the display element a plurality of times. The method includes a selection step of sequentially selecting the rows; a data read step of reading image data of an image to be displayed on the display device from a memory; a specifying step of specifying, based on scheduled image data representative of an image scheduled to be displayed on the display device before the data read step reads image data and the image data read by the data read step, changing pixels whose display state is to be newly changed among pixels in a row selected by the selection step; a boundary specifying step of specifying pixels among the pixels in the row selected by the selection step which are to be impressed with a voltage different from a voltage applied to pixels in an adjacent row, and specifies boundaries between the specified pixels and the pixels in the row adjacent to the specified pixels which are impressed with a voltage different from a voltage applied to the specified pixels; a boundary number memory step of storing a boundary number of the boundaries specified by the boundary specifying step at each of the rows; a judging step of judging as to whether or not the sum of the boundary numbers stored in the boundary number memory section is equal to or greater than a predetermined threshold value; and an update step of, when the judging step judges that the sum is less than the predetermined threshold value, starting the write operation with respect to the changing pixels to be changed to a display state defined by the image data if the changing pixels in the row selected by the selection step are not in the write operation, and starting the write operation with respect to the changing pixels to be changed to the display state defined by the image data after the ongoing write operation is finished if the changing pixels are in the write operation; and, when the judging step judges that the sum is equal to or greater than the predetermined threshold value, not starting the write operation with respect to the changing pixels until the judging step judges that the sum is less than the threshold value. According to the method described above, it is possible to achieve both an apparently higher display speed of a display device that can actually be felt and a reduction in the peak value of power consumption.

DESCRIPTION OF EXEMPLARY EMBODIMENTS

First Embodiment

Configuration of Display Device 100

Figure 1:
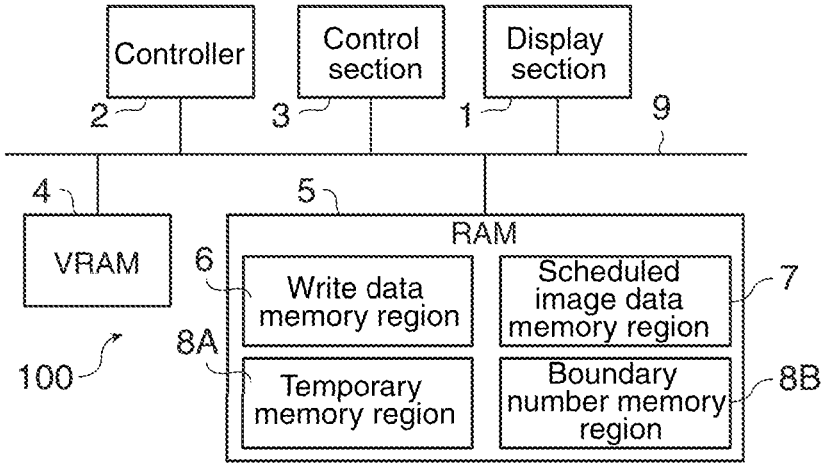
FIG. 1 is a block diagram showing a hardware configuration of a display device 100.

FIG. 1 is a block diagram showing a hardware configuration of a display device 100 in accordance with an embodiment of the invention. The display device 100 is an electrophoretic type display device, and is equipped with a display section 1, a controller 2, a control section 3, a Video RAM (VRAM) 4, and a random access memory (RAM) 5. The sections of the display device 100 are mutually connected through a bus 9. The controller 2 corresponds to a control device of the display device 100. It is noted that a portion including the controller 2 and the control section 3 combined may be defined as a control device for the display device 100. Alternatively, the entirety of the controller 2, the control section 3, the VRAM 4 and the RAM 5 may be defined as a control device for the display device 100.

The display section 1 is a display device that has display elements having memory retaining property, and maintains a displayed image even when voltages are not applied to the display elements. In accordance with the present embodiment, the display section 1 includes display elements having electrophoretic particles and displays a black and white image. The controller 2 drives the display section 1, and outputs various kinds of signals for making the display section 1 to display an image. The control section 3 is a microcomputer equipped with a control processing unit (CPU), a read only memory (ROM), a RAM and the like, and controls each of the sections of the display device 100. The control section 3 accesses to the VRAM 4, and writes various kinds of data to the VRAM 4. The VRAM 4 is a memory that stores image data indicative of an image to be displayed on the display section 1. The RAM 5 is a memory that stores data to be used for displaying an image on the display section 1, and is provided with a write data memory region 6, a scheduled image data memory region 7, a temporary memory region 8A and a boundary number memory region 8B. The write data memory region 6 is provided with a white write data memory region 6A that stores data, for each of the pixels of the display section 1, indicative of whether or not an operation of changing the display state of the pixel from black to white is in progress (first write data), and a black write data memory region 6B that stores data, for each of the pixels, indicative of whether or not an operation of changing the display state of the pixel from white to black is in progress (second write data).

Configuration of Display Section 1

Figure 2:
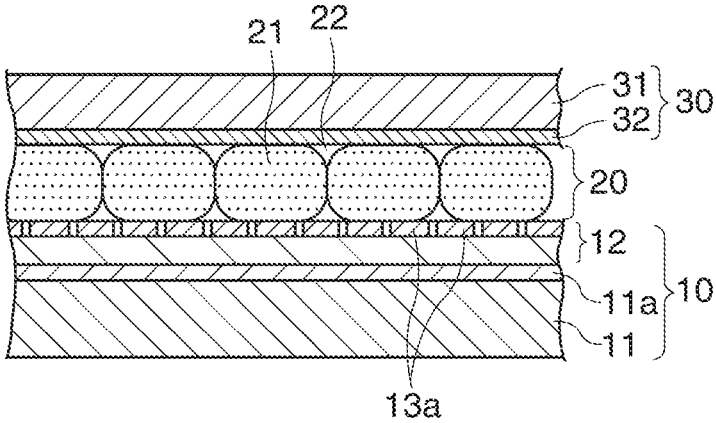
FIG. 2 is a cross-sectional view of a display section 1.
Figure 3:
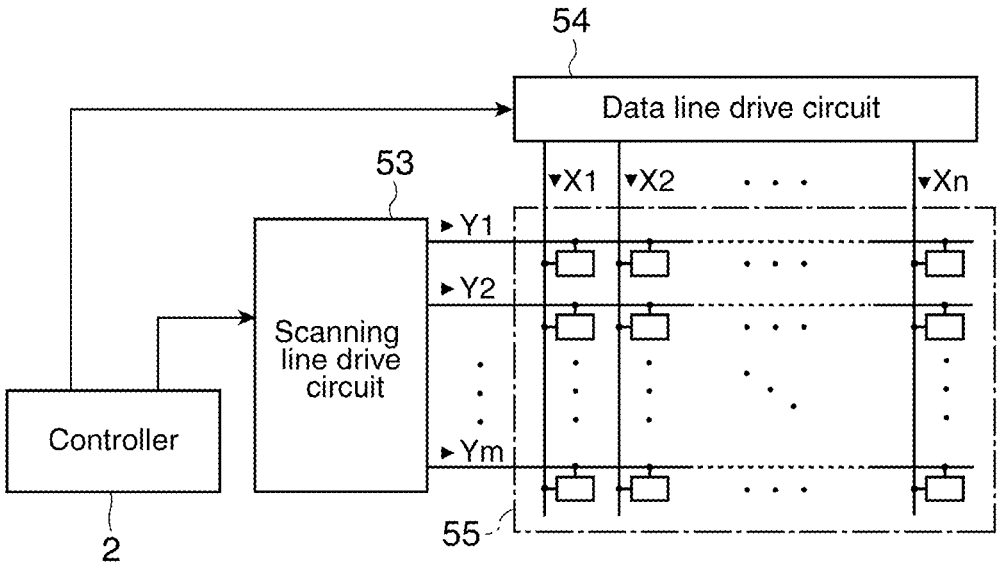
FIG. 3 is a diagram for describing a circuit configuration of the display section 1.
Figure 4:
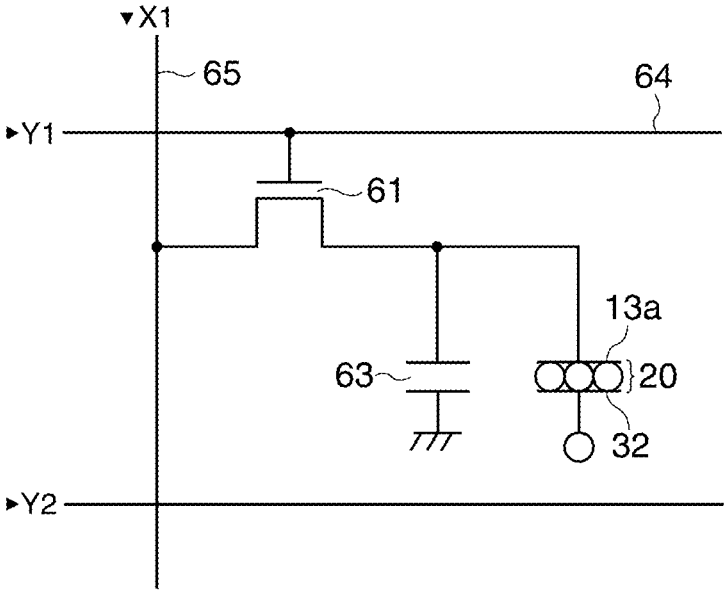
FIG. 4 is a diagram for describing a configuration of a pixel driving circuit of the display section 1.

FIG. 2 is a cross-sectional view of the display section 1. FIG. 3 is a diagram for describing a circuit configuration of the display section 1. FIG. 4 is a diagram for describing a configuration of a pixel driving circuit of the display section 1. The display section 1 is formed, as shown in FIG. 2, generally from a first substrate 10, an electrophoretic layer 20, and a second substrate 30. The first substrate 10 is a substrate having a substrate 11 having dielectric property and flexibility and a circuit layer formed thereon. The substrate 11 is made of polycarbonate in the present embodiment. It is noted that the substrate 11 may be made of any resin material that is light-weight, flexible, elastic and dielectric, without any particular limitation to polycarbonate. The substrate 11 may be formed from glass that does not have flexibility. A bonding layer 11*a* is provided on the surface of the substrate 11, and a circuit layer 12 is laminated on the surface of the bonding layer 11*a*.

The circuit layer 12 includes a plurality of scanning lines 64 arranged in a horizontal direction, and a plurality of data lines 65 arranged in a vertical direction and provided in a manner to maintain electrical insulation with respect to each of the scanning lines. Further, the circuit layer 12 includes pixel drive circuits, each composed of a pixel electrode 13*a* (first electrode) and a thin film transistor (TFT) arranged at each of the intersections of the scanning lines 64 and the data lines 65.

The electrophoretic layer 20 is formed from a binder 22 and numerous microcapsules 21 fixed by the binder 22, which is formed on the pixel electrodes 13*a*. It is noted that an adhesive layer made of adhesive may be provided between the microcapsules 21 and the pixel electrodes 13*a*.

The binder 22 may be made of any material that has good affinity with the microcapsules 21, excellent adhesion to the electrodes, and dielectric property, without any particular limitation. The microcapsules 21 each contain a dispersion medium and electrophoretic particles. The microcapsules 21 may preferably be composed of a material having flexibility, such as, composites of gum arabic and gelatin, urethane compounds, and the like.

As the dispersion medium, it is possible to use any one of materials including water; alcohol solvents (such as, methanol, ethanol, isopropanol, butanol, octanol, and methyl cellosolve); esters (such as, ethyl acetate and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, long-chain alkyl group-containing benzenes (such as, xylenes, hexylbenzene, heptylbenzene, octylbenzene, nonylbenzene, decylbenzene, undecylbenzene, dodecylbenzene, tridecylbenzene, and tetradecylbenzene); halogenated hydrocarbons (such as, methylene chloride, chloroform, carbon tetrachloride, and 1,2-dichloroethane); and carboxylates. Also, the dispersion medium may be made of any one of other various oils. The dispersion medium may use any of the materials described above alone or in combination, and may be further mixed with a surfactant.

The electrophoretic particles are particles (polymer or colloid) having a property in which the particles move in the dispersion medium by electric fields. In the present embodiment, white electrophoretic particles and black electrophoretic particles are contained in each of the microcapsules 21. The black electrophoretic particles are particles made of black pigments, such as, for example, aniline black, carbon black and the like, and are positively charged in the present embodiment. The white electrophoretic particles are particles made of white pigment, such as, for example, titanium dioxide, aluminum oxide and the like, and are negatively charged in the present embodiment.

The second substrate 30 is formed from a film 31 and a transparent electrode layer 32 (second electrode) formed on the bottom surface of the film 31. The film 31 plays a role of sealing and protecting the electrophoretic layer 20, and may be, for example, a polyethylene terephthalate film. The film 31 is transparent and has a dielectric property. The transparent electrode layer 32 is made of a transparent conductive film, such as, for example, an indium oxide film (ITO film).

Next, the circuit of the display section 1 will be described. The controller 2 outputs signals for displaying an image on the display region 55, and various kinds of signals for driving the display section 1. The display region 55 shown in FIG. 3 is provided with the plural data lines 65 arranged in parallel with the vertical direction, and the plural scanning lines 64 arranged in parallel with the horizontal direction. Also, pixel drive circuits are provided according to the respective intersections of the data lines 65 and the scanning lines 64 in the display region 55.

FIG. 4 is a diagram of the composition of the pixel drive circuit. In accordance with the present embodiment, in order to distinguish the scanning lines 64 one from the other, the scanning lines shown in FIG. 3 may be called sequentially, from the top, as the scanning lines in the $1^{st}$ row, the $2^{nd}$ row, the $3^{rd}$ row, the (m−1)-th row, and the m-th row. Similarly, in order to distinguish the data lines 65 one from the other, the data lines shown in FIG. 3 may be called sequentially, from the left, as the data lines in the $1^{st}$ column, the $2^{nd}$ column, the $3^{rd}$ column, the (n−1)-th column, and the n-th column.

FIG. 4 shows a pixel drive circuit corresponding to an intersection between the scanning line 64 in the first row and the data line 65 in the first column. The same pixel drive circuits are provided at other intersections between the data lines 65 and the scanning lines 64, and each of the pixel drive circuits has the same configuration. Therefore, the pixel drive circuit corresponding to an intersection between the scanning line 64 in the first row and the data line 65 in the first column is described below as a representative, and description of the other pixel drive circuits is omitted.

The pixel drive circuit has a transistor 61 having a gate connected to the scanning line 64. A source of the transistor 61 is connected to the data line, and a drain of the transistor 61 is connected to the pixel electrode 13*a*. The pixel electrode 13*a* is disposed opposite to the transparent electrode layer 32, and the electrophoretic layer 20 is sandwiched between the pixel electrode 13*a* and the transparent electrode layer 32. The microcapsule 21 that is present between one pixel electrode 13*a* and the transparent electrode layer 32 defines one of the pixels in the display section 1. In the pixel drive circuit, a retention capacitance 63 is connected in parallel with the electrophoretic layer 20. Also, the potential on the transparent electrode layer 32 is set at a predetermined potential Vcom.

A scanning line drive circuit 53 is connected to each of the scanning lines 64 of the display region 55, and supplies scanning signals Y1, Y2, . . . , Ym to the scanning lines 64 in the $1^{st}$ row, the $2^{nd}$ row, . . . , the m-th row, respectively. More specifically, the scanning line drive circuit 53 sequentially selects the scanning lines 64 from the $1^{st}$, the $2^{nd}$, . . . to the m-th row, in this order, and provides a scanning signal with a selected voltage $V_H$ (H level) to selected ones of the scanning lines 64, and a scanning signal with a non-selected voltage $V_L$ (L level) to non-selected ones of the scanning lines.

A data line drive circuit 54 is connected to each of the data lines in the display region, and supplies data signals X1, X2, . . . , Xn to the data lines 65 in the $1^{st}$ column, the $2^{nd}$ column, and the n-th column, respectively. A data signal is supplied from the data lines 65 to the pixel drive circuits connected to the scanning lines 64 whose potential is at the selected potential $V_H$. More specifically, when the scanning line 64 is at H level, the transistors 61 having the gates connected to the scanning line 64 turn on, and the pixel electrodes 13*a* are connected to the data lines 65. Therefore, by supplying a data signal to the data lines 65 when the scanning line 64 is at H level, the data signal is applied to the pixel electrodes 13*a* through the transistors 61 that are turned on. When the scanning line 64 turns to L level, the transistors 61 are turned off. However, the voltage applied to the pixel electrodes 13*a* by the data signal is stored in the retaining capacitances 63, whereby the electrophoretic particles move according to a potential difference (a voltage) between the potential on the pixel electrodes 13*a* and the potential on the transparent electrode layer 32. For example, when the potential on the pixel electrodes 13*a* is +15V with respect to the potential Vcom on the transparent electrode layer 32, the negatively charged white electrophoretic particles move toward the pixel electrode 13*a*, and the positively charged black electrophoretic particles move toward the transparent electrode layer 32, such that the pixels exhibit a black display. When the potential on the pixel electrodes 13*a* is −15V with respect to the potential Vcom on the transparent electrode layer 32, the positively charged black electrophoretic particles move toward the pixel electrodes 13*a*, and the negatively charged white electrophoretic particles move toward the transparent electrode layer 32, such that the pixels exhibit a white display.

In the following description, a period starting from the selection of the scanning line in the first row by the scanning line drive circuit 53 until the completion of the selection of the scanning line in the Y-th row is referred to as a "frame period" or, simply a "frame." Each of the scanning lines 64 is selected once in each frame, and a data signal is supplied to each of the pixel drive circuits once in each frame. Also, in accordance with the present embodiment, when the display state of each of the pixels is changed from white (low density) to black (high density) or from black to white, the display state is not changed only in one frame by driving the pixel drive circuit. Instead, the display state is changed by a write operation in which voltages are applied to the pixels across a plurality of frames. This is necessary because, when changing the display state from white to black, the black electrophoretic particles do not completely migrate to the display side by application of a potential difference to the electrophoretic particles in one frame, and therefore the display state does not perfectly turn to black. This phenomenon similarly occurs with the white electrophoretic particles, when changing the display state of the pixels from white to black. Therefore, when changing the display state of pixels from white to black, data signals for causing the pixels to present a black color are supplied to the pixel drive circuits through a plurality of frames; and when changing the display state of pixels from black to white, data signals for causing the pixels to present a white color are supplied across a plurality of frames. Further, in the present embodiment, the pixel electrodes 13*a* of some of the pixels within one frame may be set as positive electrodes which have a higher potential with respect to the transparent electrode layer 32, and the pixel electrodes 13*a* of the other pixels within the same frame may be set as negative electrodes which have a lower potential with respect to the transparent electrode layer 32. In other words, the pixel electrodes can be driven by a driving scheme in which both of the polarities, the positive polarity and the negative polarity, can be selected with respect to the transparent electrode layer 32 within each frame (hereafter referred to as a bipolar driving).

Configuration of Controller 2

Figure 5:
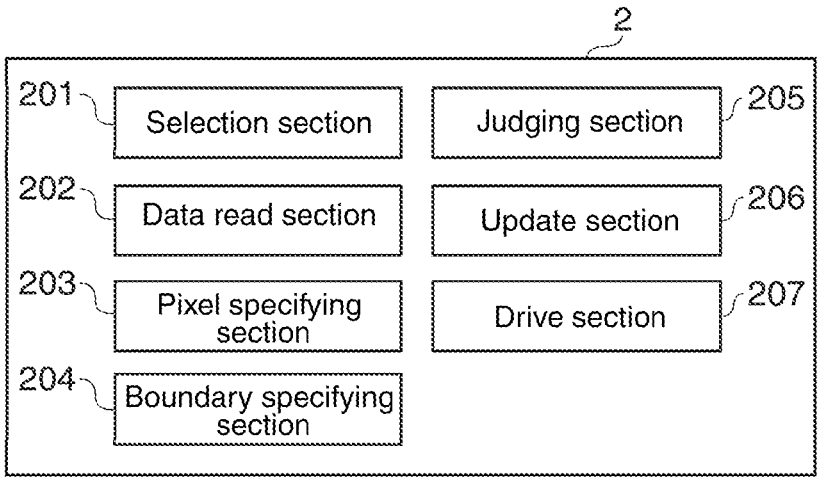
FIG. 5 is a block diagram of a functional configuration realized by a controller 2.

Next, the configuration of the controller 2 is described. FIG. 5 is a block diagram showing functions to be realized by the controller 2. The controller 2 realizes a selection section 201, a data read section 202, a pixel specifying section 203, a boundary specifying section 204, a judging section 205, an update section 206 and a drive section 207. It is noted that these sections can be realized by hardware. Alternatively, the controller 2 may be provided with a CPU, and a program may be executed by the CPU to realize these sections.

The selection section 201 is a block that sequentially selects the pixels arranged in plural rows and plural columns in the unit of a row. The data read section 202 is a block that reads image data stored in the VRAM. The pixel specifying section 203 is a block that compares data read by the data read section 202 with data stored in the scheduled image data storage region 7 to specify pixels whose display state is to be newly changed. The boundary specifying section 204 is a block that specifies pixels among the pixels in a row selected by the selection section 201 which are to be impressed with a voltage different from a voltage applied to pixels in an adjacent row, and specifies boundaries between the specified pixels and the pixels in the row adjacent to the specified pixels which are impressed with a voltage different from a voltage applied to the specified pixels. The judging section 205 is a block that judges as to whether or not the number of boundaries (the boundary numbers) specified by the boundary specifying section 204 is equal to or greater than a predetermined threshold value. The update section 206 is a block that controls the start of a pixel writing operation. The drive section 207 is a block that controls the scanning line drive circuit 53 and the data line drive circuit 54 such that data signals are supplied to the pixel electrodes 13*a*.

Operation of Embodiment

Next, the operation of the display device 100 is described. It is noted that, in FIG. 8 and thereafter, an image A represents an image displayed on the display section 1. A pixel Pij represents one pixel. Here, the index i indicates a row number of the pixel arranged in a matrix of rows and columns, and the index j indicates a column number of the pixel. When pixels are specified in the following description, the indexes are used as follows. For example, a pixel in the first row and in the first column is referred to as a pixel P11. In the image A, each of the pixels is appended with a number between 0 and 7 that indicate respectively eight levels of gradation from black to white in order to readily understand the gradation of each of the pixels. Also, in the display section 1, the pixels are present respectively at all the intersections of the m scanning lines 64 and the n data lines 65. However, in order to avoid complexity in the drawings, the operations will be described below with reference to an example in which the display section 1 is composed of pixels in a matrix of 4 rows and 4 columns P11-P44.

Also, in the figures showing contents of the image A, contents of the memory region Aij in the VRAM 4 corresponding to the pixels P11-P44, contents of the memory region Bij in the scheduled image data memory region 7 corresponding to the pixels P11-P44, contents of the memory region Cij in the white write data memory region 6A corresponding to the pixels P11-P44, and contents of the memory region Dij in the black write data memory region 6B corresponding to the pixels P11-P44 are also shown. It is noted that the index i appended with each of the memory regions represents a row number of the memory region arranged in a matrix, and the index j represents a column number thereof. For example, for specifying a pixel and a memory region for description, for example, a memory region Aij in the first row and in the first column is referred to as a memory region A11, and a pixel in the first row and in the first column is referred to as P11.

Also, in the figures showing contents of the image A, contents of the boundary number memory region 8B are also shown. In the boundary number memory region 8B, memory regions are provided corresponding to spaces between the multiple lines of pixels. It is noted that the index i of a memory region Gi represents a row number of the memory region. In accordance with the present embodiment, pixels among the pixels in an i-th row with which a voltage that is different from a voltage applied to pixels in an (i−1)-th row is applied are specified, at each of the columns, and the sum of boundaries between the specified pixels and the pixels in the (i−1)-th row is stored in the memory region Gi. Also, pixels among the pixels in the i-th row with which a voltage that is different from a voltage applied to pixels in an (i+1)-th row is applied are specified, at each of the columns, and the sum of boundaries between the specified pixels and the pixels in the (i+1)-th row is stored in the memory region Gi+1. It is noted that, because the (i−1)-th row does not exist for the first row ($1^{st}$ row) of the pixels in the multiple rows, the number of pixels with which a voltage is applied to the pixel electrodes 13*a* in the first row is stored in G1. Also, because the (i+1)-th row does not exist for the last row ($4^{th}$ row) of the pixels in the multiple rows, the number of pixels with which a voltage is applied to the pixel electrodes 13*a* in the last row is stored in G5.

The memory regions A11-A44 of the VRAM 4 store levels of gradation of the respective corresponding pixels of the image displayed on the display section 1, and the memory regions B11-B44 of the scheduled image data memory region 7 stores levels of gradation of the respective corresponding pixels of an image scheduled to be displayed on the display section 1. The memory regions C11-C44 of the white write data memory region 6A each store the number of voltage applications necessary to turn the pixels P11-P44 to white as first write data, respectively. The memory regions D11-D44 of the black write data memory region 6B each store the number of voltage applications necessary to turn the pixels P11-P44 to black as second write data, respectively. The first write data and the second write data, when they are not 0, indicate that a rewriting operation to pixels is in progress. On the other hand, when they are 0, they indicate that a rewriting operation to pixels has been completed.

Figure 6:
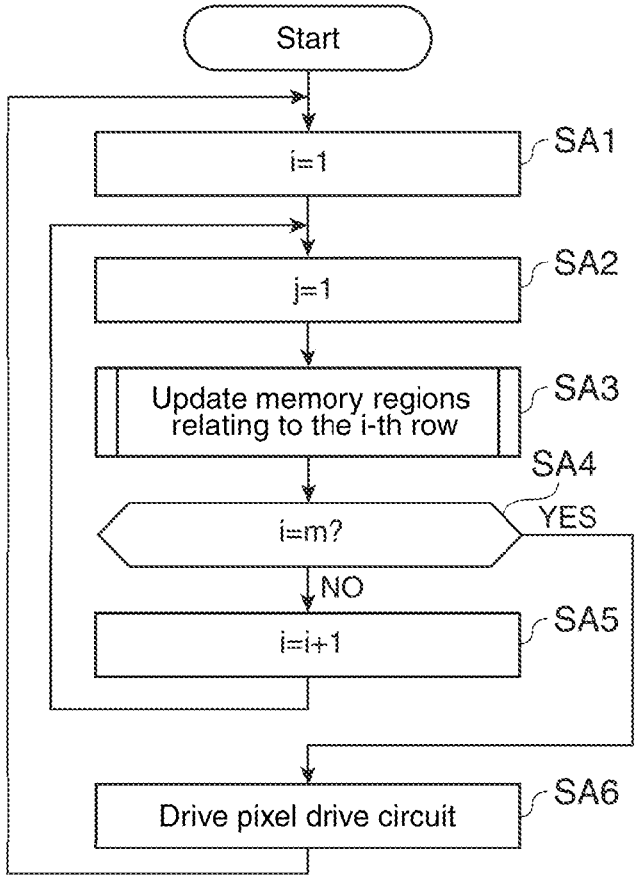
FIG. 6 is a flow chart of processes performed by the controller 2.
Figure 7:
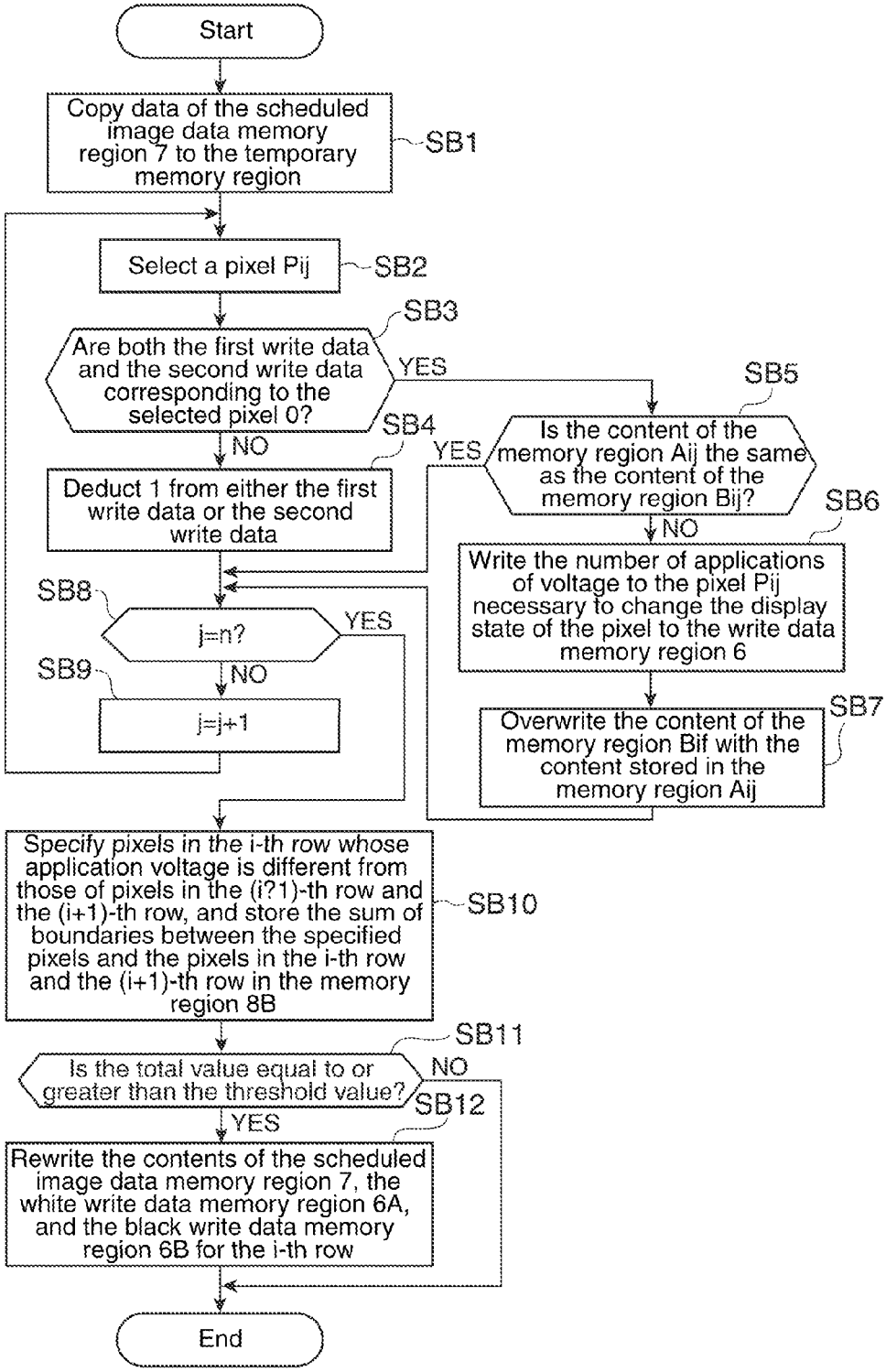
FIG. 7 is a flow chart of processes performed by the controller 2.

When driving pixels, the controller 2 executes processes shown in FIGS. 6 and 7. First, the controller 2 initializes values of the variables i and j to 1 (steps SA1 and SA2). Next, the controller 2 selects the i-th row of pixels among the pixels arranged in a plurality of rows and a plurality of columns, and performs a process of updating the contents of the memory region concerning the pixels in the selected i-th row (step SA3). In other words, the selection section 201 of the controller 2 functions here.

In step SA3, the controller 2 copies data for the i-th row of the scheduled image data memory region 7 to the temporary memory region 8A (step SB1). Then, the controller 2 selects a pixel Pij specified by variables i and j (step SB2). For example, when the value of the variable i is 1, and the value of the variable j is 1, a pixel P11 is selected. Next, the controller 2 judges as to whether or not both of the first write data stored in the memory region Cij and the second write data stored in the memory region Dij corresponding to the selected pixel Pij are 0 (step SB3). When both of the first write data stored in the memory region Cij and the second write data stored in the memory region Dij corresponding to the selected pixel Pij are 0 (YES in step SBA the controller 2 proceeds to step SB5. When one of the first write data and the second write data is other than 0 (NO in step SBA the controller 2 proceeds to step SB4. In step SB4, the controller 2 deducts 1 from the first write data stored in the memory region Cij or the second write data stored in the memory region Dij whose value is other than 0. It is noted that deduction of 1 is not performed for the first write data or the second write data whose value is 0.

On the other hand, the controller 2, as it proceeds to step SB5, reads data stored in the memory region Aij (by the data read section 202), and compares the same with data stored in the memory region Bij. Here, if they are different from each other (NO in step SB5), the controller 2 specifies the pixel Pij as a pixel whose display state is to be newly changed (by the pixel specifying section 203), and updates the data concerning the specified pixel Pij. More specifically, the controller 2 (the update section 206) writes, to the write data memory region 6, the number of voltage applications to the pixel necessary to change the gradation of the pixel Pij to the gradation of the memory region Aij (step SB6). Also, the controller 2 overwrites the content of the memory region Bij with the content stored in the memory region Aij (step SB7).

Next, the controller 2 judges as to whether the value of the variable j is the same as the number n of the data lines (step SB8). If the value of the variable j is not the same as n (NO in step SB8), the controller 2 adds 1 to the value of the variable j (step SB9), and proceeds to step SB2. On the other hand, if the value of the variable j is n (YES in step SB8), the controller 2 specifies, at each of the columns, pixels among the pixels in the i-th row with which a voltage that is different from a voltage applied to pixels in the (i−1)-th row is applied, and the sum of boundaries between the specified pixels and the pixels in the (i−1)-th row is stored in the memory region Gi. Also, the controller 2 specifies, at each of the columns, pixels among the pixels in the i-th row with which a voltage that is different from a voltage applied to pixels in the (i+1)-th row is applied, and the sum of boundaries between the specified pixels and the pixels in the (i+1)-th row is stored in the memory region Gi+1 (step SB10 (by the boundary specifying section 204)).

Next, the controller 2 sums up the values stored in the boundary number memory region 8B, and judges as to whether or not the sum is equal to or greater than a predetermined threshold value (step SB 11 (by the judging section 205). The controller 2, when the sum is less than the threshold value (NO in step SB11), proceeds to step SA4. On the other hand, when the sum is equal to or greater than the threshold value (YES in step SB11), the controller 2 rewrites the contents of the memory regions in the i-th row (step SB12). More specifically, the scheduled image data memory region 7 is overwritten with the contents stored in the temporary memory region 8A. Also, as to the white write data memory region 6A and the black write data memory region 6B, the contents of those of the memory regions storing 7 are rewritten to 0.

In step SA4, the controller 2 judges as to whether or not the value of the variable i is the same as the number m of the scanning lines. If the value of the variable i is not m (NO in step SA4), the controller 2 adds 1 to the value of the variable i (step SA5), and proceeds to step SA2. On the other hand, if the value of the variable i is m (YES in step SA4), the controller 2 controls the scanning line drive circuit 53 and the data line drive circuit 54 to drive the pixel drive circuits (step SA6 (by the drive section 207)).

Next, referring to the drawings, changes in the display on the display section 1, changes in the contents of the VRAM 4, and changes in the contents of the RAM 5 from the time when image data is written to the VRAM4 until an image of the image data is displayed on the display section 1 are described.

Figure 8:
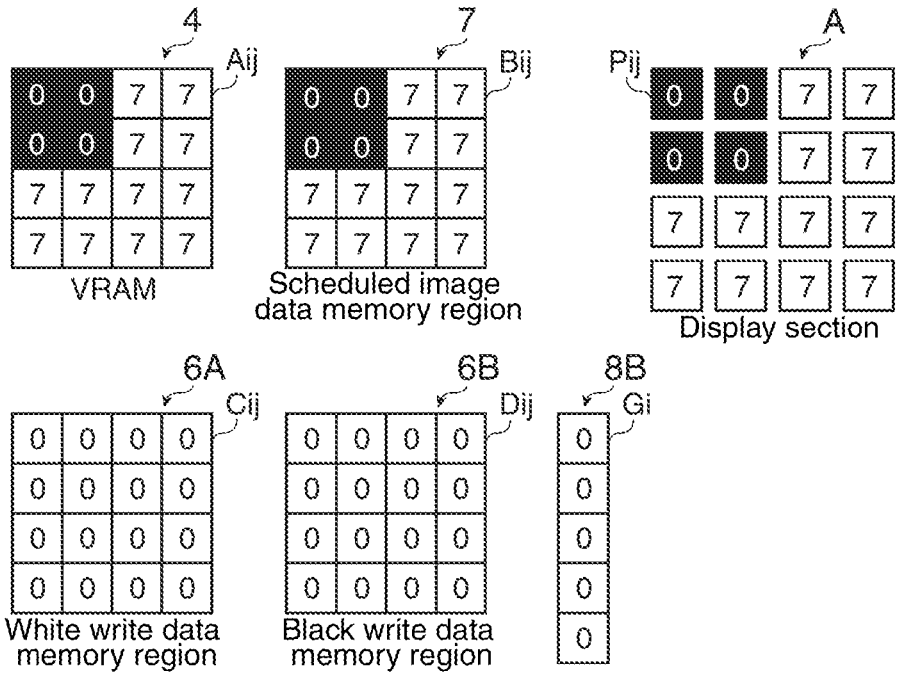
FIG. 8 shows diagrams for describing operations of a display device 100.
Figure 9:
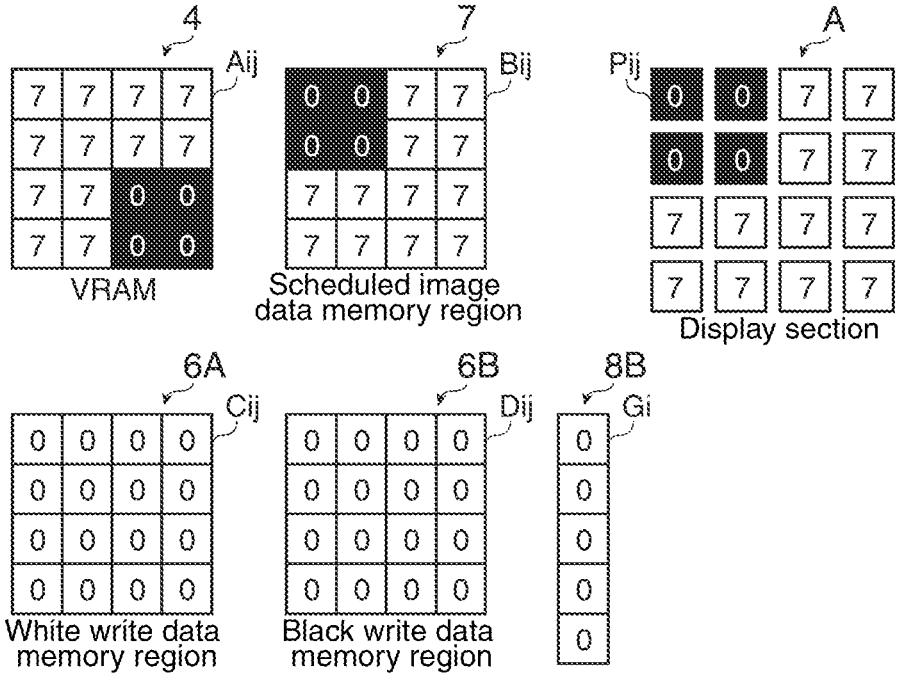
FIG. 9 shows diagrams for describing operations of the display device 100.
Figure 10:
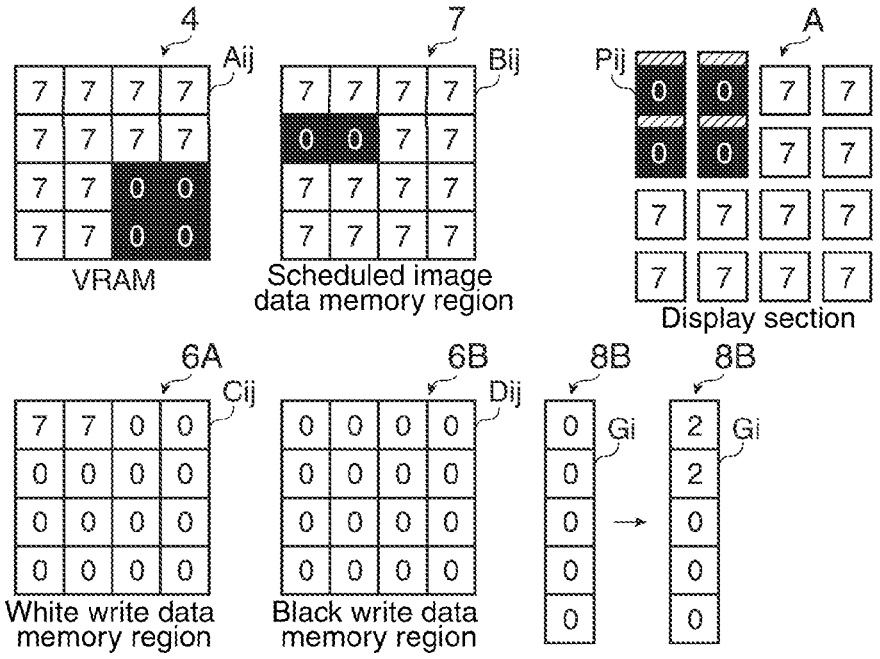
FIG. 10 shows diagrams for describing operations of the display device 100.

When the control section 3 writes image data to the VRAM 4 when the display on the display section 1, the VRAM 4, the write data memory region 6, the scheduled image data memory region 7 and the boundary number memory region 8B are in the state shown in FIG. 8, the state of the VRAM 4 changes according to the image data to a state as shown in FIG. 9. When a pixel P11 is selected in step SB2 in the state shown in FIG. 9, a judgment YES is made in step SB3, and a judgment NO is made in step SB5. The content of the memory region B11 indicates black, and the content of the memory region A11 indicates white, such that the pixel P11 will be changed from black to white. Accordingly, in step SB6, 7 is written to the memory region C11, and the content of the memory region A11 is written to the memory region B11 in step SB7. Next, when a pixel P12 is selected, a judgment YES is made in step SB3, and a judgment NO is made in step SB5. Accordingly, in step SB6, 7 is written to the memory region C12, and the content of the memory region A12 is written to the memory region B12 in step SB7, as shown in FIG. 10.

Thereafter, the process is advanced, and when a judgment YES is made in step SB8, the controller performs the process in step SB 10. More specifically, the controller 2 specifies memory regions that store a value other than 0 in the i-th row of the white write data memory region 6A which are adjacent to memory regions in the adjacent (i−1)-th row that store 0, and specifies memory regions that store 0 in the i-th row of the white write data memory region 6A which are adjacent to memory regions in the adjacent (i−1)-th row that store a value other than 0. Then, boundaries of the pixels corresponding to the specified memory regions are specified with respect to the (i−1)-th row. Further, the controller 2 specifies memory regions that store a value other than 0 in the i-th row of the white write data memory region 6A which are adjacent to memory regions in the adjacent (i+1)-th row that store 0, and specifies memory regions that store 0 in the i-th row of the white write data memory region 6A which are adjacent to memory regions in the adjacent (i+1)-th row that store a value other than 0. Then, boundaries of the pixels corresponding to the specified memory regions are specified with respect to the (i+1)-th row.

Also, the controller 2 specifies memory regions that store a value other than 0 in the i-th row of the black write data memory region 6B which are adjacent to memory regions in the adjacent (i−1)-th row that store 0, and specifies memory regions that store 0 in the i-th row of the black write data memory region 6B which are adjacent to memory regions in the adjacent (i−1)-th row that store a value other than 0. Then, boundaries of the pixels corresponding to the specified memory regions are specified with respect to the (i−1)-th row. Further, the controller 2 specifies memory regions that store a value other than 0 in the i-th row of the black write data memory region 6B which are adjacent to memory regions in the adjacent (i+1)-th row that store 0, and specifies memory regions that store 0 in the i-th row of the black write data memory region 6B which are adjacent to memory regions in the adjacent (i+1)-th row that store a value other than 0. Then, boundaries of the pixels corresponding to the specified memory regions are specified with respect to the (i+1)-th row.

As described below, at pixels corresponding to the memory regions in the white write data memory region 6A which store a value other than 0, a voltage is applied to the pixel electrodes 13*a* such that they have −15V with respect to the potential Vcom of the transparent electrode layer 32. Here, when any of the memory regions in the adjacent (i−1)-th row and the adjacent (i+1)-th row store 0, the pixel electrodes 13*a* of the pixels corresponding to the adjacent memory regions are impressed with a voltage other than −15V with respect to the potential Vcom of the transparent electrode layer 32. Further, at pixels corresponding to the memory regions in the white write data memory region 6A which store 0, a voltage is applied to the pixel electrodes 13*a* such that they have a potential difference other than −15V with respect to the potential Vcom of the transparent electrode layer 32. Here, when any of the memory regions in the adjacent (i−1)-th row and the adjacent (i+1)-th row store a value other than 0, a voltage is applied at the pixels corresponding to the adjacent memory regions such that a potential difference of the pixel electrodes 13*a* with respect to the potential Vcom of the transparent electrode layer 32 becomes a voltage of −15V.

Also, at pixels corresponding to the memory regions in the black write data memory region 6B which store a value other than 0, a voltage is applied to the pixel electrodes 13*a* such that they have +15V with respect to the potential Vcom of the transparent electrode layer 32. Here, when any of the memory regions in the adjacent (i−1)-th row and the adjacent (i+1)-th row store 0, the pixels corresponding to the adjacent memory regions are impressed with a voltage other than +15V with respect to the potential Vcom of the transparent electrode layer 32. Also, at pixels corresponding to the memory regions in the black write data memory region 6B which store 0, a voltage is applied to the pixel electrodes 13*a* such that they have a potential difference other than +15V with respect to the potential Vcom of the transparent electrode layer 32. Here, when any of the memory regions in the adjacent (i−1)-th row and the adjacent (i+1)-th row store a value other than 0, a voltage is applied at the pixels corresponding to the adjacent memory regions such that a potential difference of the pixel electrodes 13*a* with respect to the potential Vcom of the transparent electrode layer 32 becomes to be a voltage of +15V.

In other words, when any memory regions in the i-th row store a value other than 0, and their adjacent memory regions in the (i−1)-th row and the (i+1)-th row store 0, and when any memory regions in the i-th row store 0, and their adjacent memory regions in the (i−1)-th row and the (i+1)-th row store a value other than 0, pixels corresponding to the memory regions in the i-th row are impressed with a voltage that is different from a voltage applied in the (i−1)-th row and the (i+1)-th row. In other words, it can be said that boundaries between the pixels in the i-th row and their adjacent pixels are areas where power is consumed. Therefore, by specifying the boundary portions that consume power, and counting the number of the specified portions, the power consumption for displaying an image can be estimated.

For example, in the case of i=1, at the time when update of the contents of the memory regions in the first row has been completed, the contents of the memory regions are in a state shown in FIG. 10. As the memory regions C11 and C12 store 7 as shown in FIG. 10, the controller 2 specifies the memory regions C11 and C12. Here, it can be said that hatched portions on the upper side of the first row in the image A shown in FIG. 10 are portions where power is consumed. The controller 2 stores the number of the specified portions "2" in the memory region G1. Also, comparing the i-th row (the first row) and the (i+1)-th row (the second row), the controller 2 specifies the memory region C11, because the memory region C11 in FIG. 10 stores 7, and the memory region C21 adjacent to the memory region C11 stores 0. Also, the controller 2 specifies the memory region C12, because the memory region C12 stores 7, and the memory region C22 adjacent to the memory region C12 stores 0. Here, hatched portions between the first row and the second row in the image A shown in FIG. 10 are specified as portions where power is consumed. The controller 2 stores the number of the specified portions "2" in the memory region G2. The content of the boundary number memory region 8B is changed to a state, as shown in FIG. 10, where 2 is stored in the memory region G1 and 2 is stored in the memory region G2.

Next, the controller 2 judges as to whether the sum of the values stored in the boundary number memory region 8B is equal to or greater than a predetermined threshold value (step SB11). For example, if the power consumption exceeds the amount of power supplied by the power supply circuit of the display device 100, and a voltage necessary to change the display state of the pixels can no longer be impressed when the sum of the numbers stored in the boundary number memory region 8B becomes 10 or greater, then the threshold value is set at 10. In this embodiment, since the total of the values stored in the boundary number memory region 8B is 4, a judgment NO is made in step SB11, and the process proceeds to step SA4.

Figure 11:
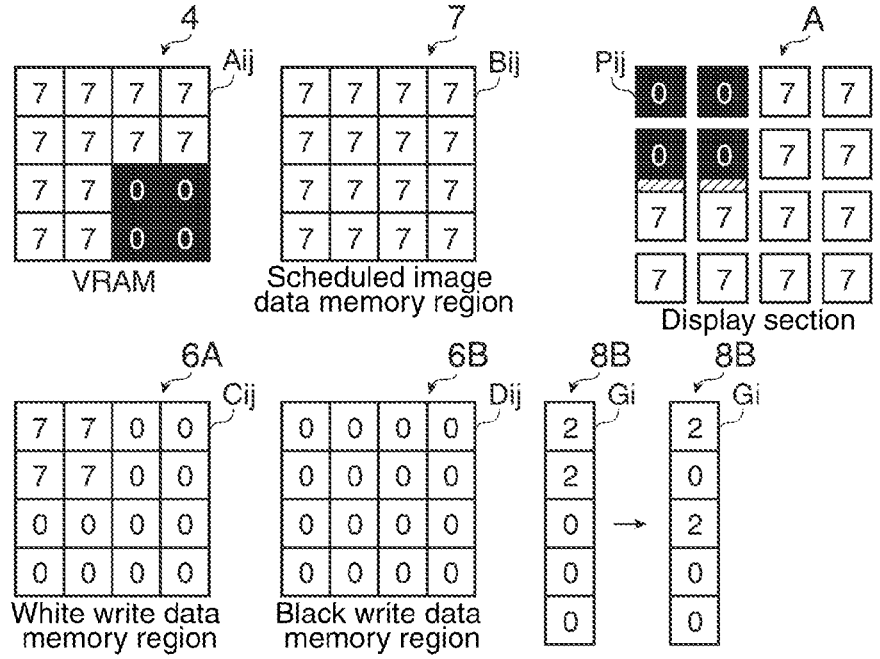
FIG. 11 shows diagrams for describing operations of the display device 100.

Then, as the process in step SA5 is executed where i is set to 2 (i=2), and when the process is advanced until a judgment YES is made in step SB8, the contents in the memory regions assume a state shown in FIG. 11. Here, the process in step SB10 is executed, and as the memory regions C21 and C22 store 7, and the memory regions C31 and C32 store 0, the controller 2 specifies the memory region C21 and C22. Here, hatched portions between the second row and the third row in the image A shown in FIG. 11 are specified as portions where power is consumed. The controller 2 stores the number of the specified portions "2" in the memory region G3. The content of the boundary number memory region 8B is changed to a state, as shown in FIG. 11, wherein 2 is stored in the memory region G3. It is noted that, because no specified portion exists between the first row and the second row, 0 is stored in the memory region G2.

Next, the controller 2 executes the process in step SB11. As the total of the values stored in the boundary number memory region 8B at this moment is 4, a judgment NO is made in step SB11, and the process proceeds to step SA4.

Figure 12:
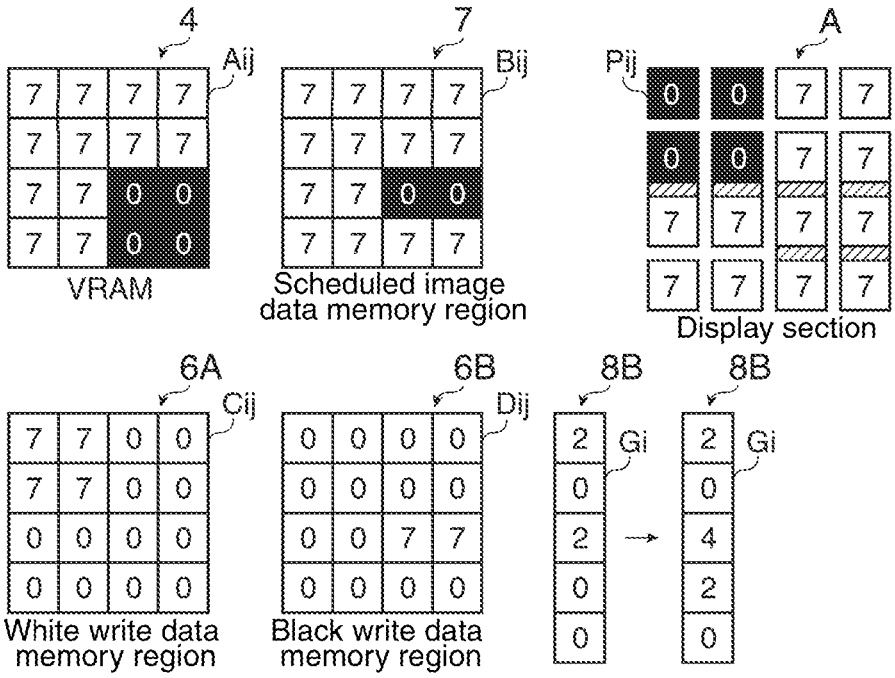
FIG. 12 shows diagrams for describing operations of the display device 100.

Then, as the process in step SA5 is executed where i is set to 3 (i=3), and when the process is advanced up to a point where a judgment YES is made in step SB8, the contents in the memory regions assume a state shown in FIG. 12. Here, the process in step SB10 is executed. Referring to the second row and the third row of the memory regions, as the memory regions C21 and C22 store 7, and the memory regions C31 and C32 store 0, the controller 2 specifies the memory region C31 and C32. Also, the memory regions D33 and D34 store 7, and the memory regions D23 and D24 store 0, such that the controller 2 specifies the memory regions D33 and D34. Here, hatched portions between the second row and the third row in the image A shown in FIG. 12 are specified as portions where power is consumed. The controller 2 stores the number of the specified portions "4" in the memory region G3. Further, referring to the memory regions in the third row and the fourth row, the memory regions D33 and D34 store 7, and the memory regions D43 and D44 store 0, such that the controller 2 specifies the memory regions D33 and D34. Here, hatched portions between the third row and the fourth row in the image A shown in FIG. 12 are specified as portions where power is consumed. The controller 2 stores the number of the specified portions "2" in the memory region G4. Here, the contents of the boundary number memory region 8B are changed to a state, as shown in FIG. 12, wherein the contents in the memory region G3 and the memory region G4 are changed.

Next, the controller 2 executes the process in step SB11. As the total of the values stored in the boundary number memory region 8B at this moment is 8, a judgment NO is made in step SB11, and the process proceeds to step SA4.

Figure 13:
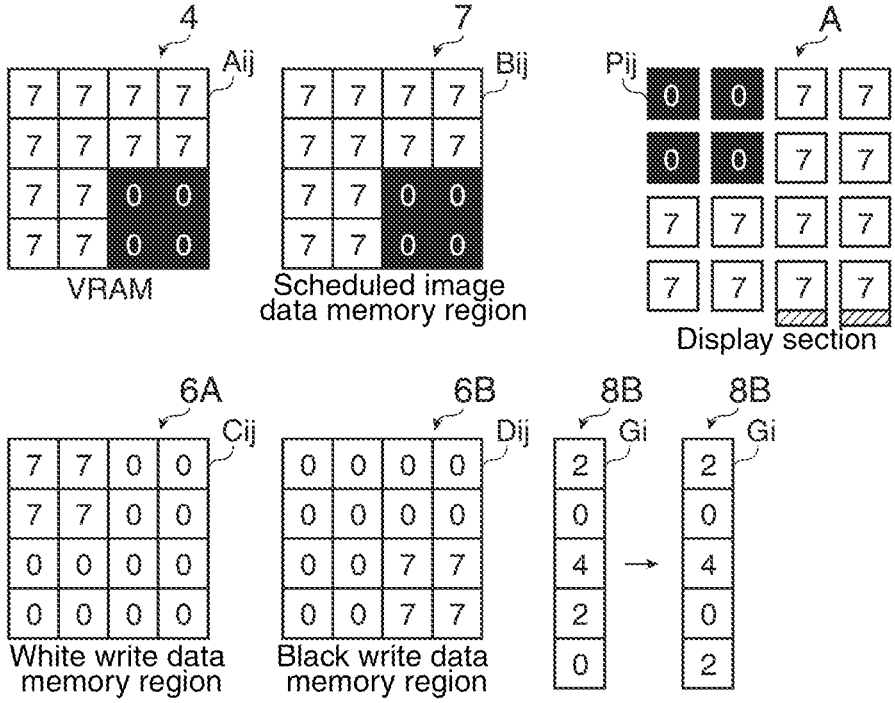
FIG. 13 shows diagrams for describing operations of the display device 100.

Then, as the process in step SA5 is executed where i is set to 4 (i=4), and when the process is advanced up to a point where a judgment YES is made in step SB8, the contents in the memory regions assume a state shown in FIG. 13. Here, the process in step SB10 is executed. As the memory regions D43 and D44 store 7, the controller 2 specifies the memory regions D43 and D44. Here, hatched portions on the lower sides of the fourth row in the image A shown in FIG. 13 are specified as portions where power is consumed. The controller 2 stores the number of the specified portions "2" in the memory region G5. It is noted that, because no specified portion exists between the third row and the fourth row, 0 is stored in the memory region G4. Here, the contents of the boundary number memory region 8B are changed, wherein the contents in the memory region G4 and the memory region G5 are changed, as shown in FIG. 13.

Next, the controller 2 executes the process in step SB11. As the total of the values stored in the boundary number memory region 8B at this moment is 8, a judgment NO is made in step SB11, and the process proceeds to step SA4.

Later, the process in step SA6 is executed. At a pixel drive circuit corresponding to the pixel P11 (a pixel drive circuit corresponding to an intersection between the scanning line 64 in the first row and the data line 65 in the first column), as the content of the memory region C11 is other than 0, a voltage is applied to the data line 65 such that the potential on the pixel electrode 13*a*, when the scanning line 64 is selected, becomes −15V with respect to the potential Vcom of the transparent electrode layer 32. Also, at pixel drive circuits corresponding to the pixels P12, P21 and P22, as the content of each of the memory regions C12, C21 and C22 is other than 0, a voltage is applied to the data lines 65 such that the potential on the pixel electrodes 13*a*, when the scanning line 64 is selected, becomes −15V with respect to the potential Vcom of the transparent electrode layer 32.

Also, at a pixel drive circuit corresponding to the pixel P33 (a pixel drive circuit corresponding to an intersection between the scanning line 64 in the third row and the data line 65 in the third column), as the content of the memory region D33 is other than 0, a voltage is applied to the data line 65 such that the potential on the pixel electrode 13*a*, when the scanning line 64 is selected, becomes +15V with respect to the potential Vcom of the transparent electrode layer 32. Also, at pixel drive circuits corresponding to the pixels P34, P43 and P44, as the content of each of the memory regions D34, D43 and D44 is other than 0, a voltage is applied to the data lines 65 such that the potential on the pixel electrodes 13*a*, when the scanning line 64 is selected, becomes +15V with respect to the potential Vcom of the transparent electrode layer 32.

Figure 14:
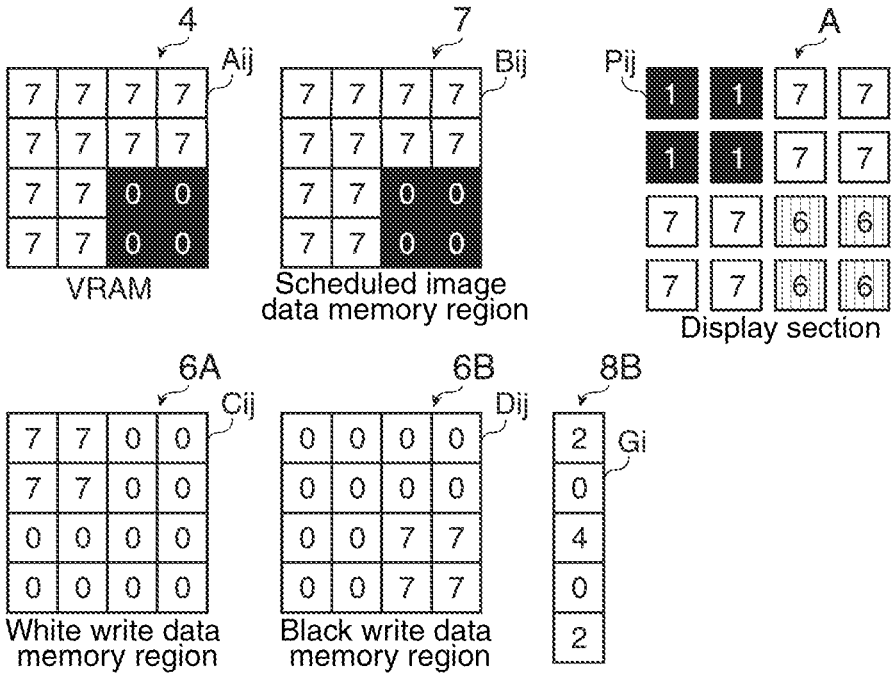
FIG. 14 shows diagrams for describing operations of the display device 100.

As to the other pixels, the contents of their corresponding memory regions in the white write data memory region 6A are 0, and also the contents of their corresponding memory regions in the black write data memory region 6B are 0, such that a voltage is applied to the data lines 65 such that the difference between the potential on the pixel electrodes 13*a* and the potential Vcom on the transparent electrode layer 32 becomes 0V, when the scanning line 64 is selected. In this manner, as the voltage is applied to the data lines 6, the white particles and the black particles in the pixels migrate, and the display of the display section 1 assumes a state shown in FIG. 14.

Upon completion of the process in step SA6, the controller 2 returns the process flow to step SA1. Then, the process is advanced, and when the pixel P11 is selected in the state shown in FIG. 14 in step SB2, a judgment NO is made in step SB3, 1 is deducted from the value written to the memory region C11, whereby the content of the memory region C11 becomes 6. Next, when the pixel P12 is selected, a judgment NO is made in step SB3, and 1 is deducted from the value written to the memory region C12, whereby the content of the memory region C12 becomes 6. Thereafter, as the process continues and then the pixel P44 is selected, the contents of the memory regions C11, C12, C21 and C22 become 6, as shown in FIG. 15, and thus the contents of the memory regions D33, D34, D43 and D44 become 6.

Figure 15:
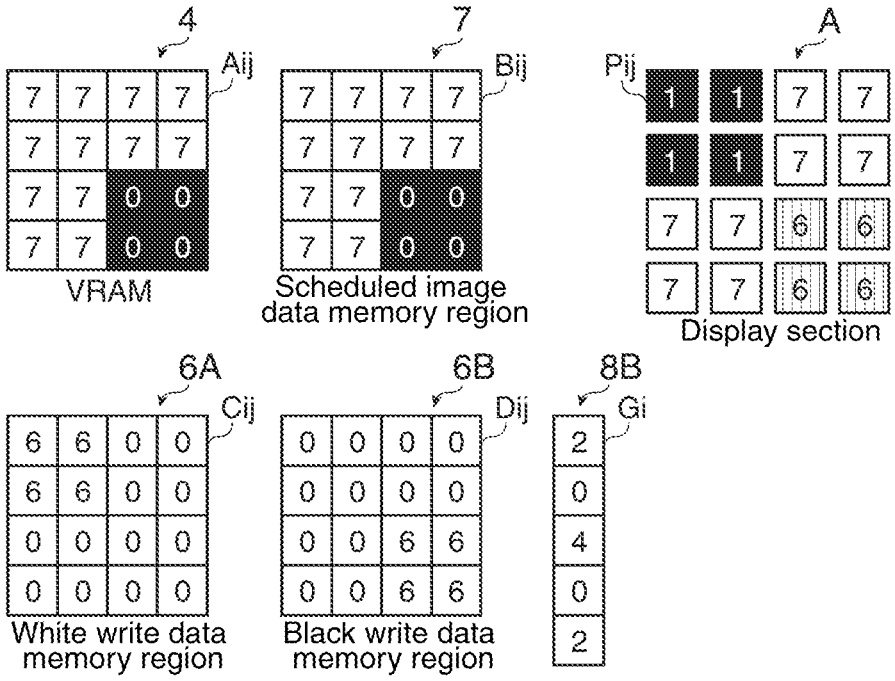
FIG. 15 shows diagrams for describing operations of the display device 100.
Figure 16:
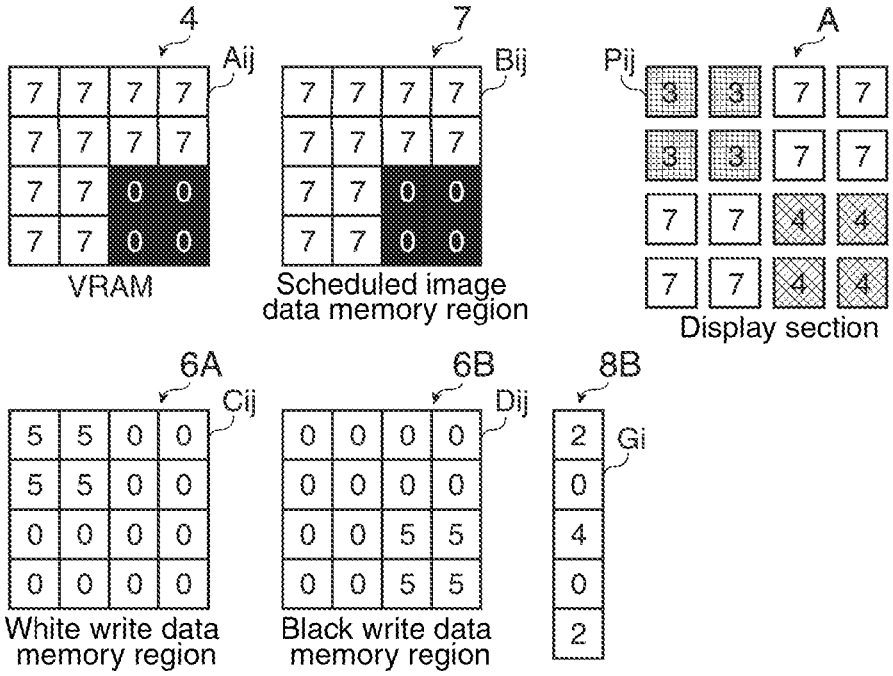
FIG. 16 shows diagrams for describing operations of the display device 100.
Figure 17:
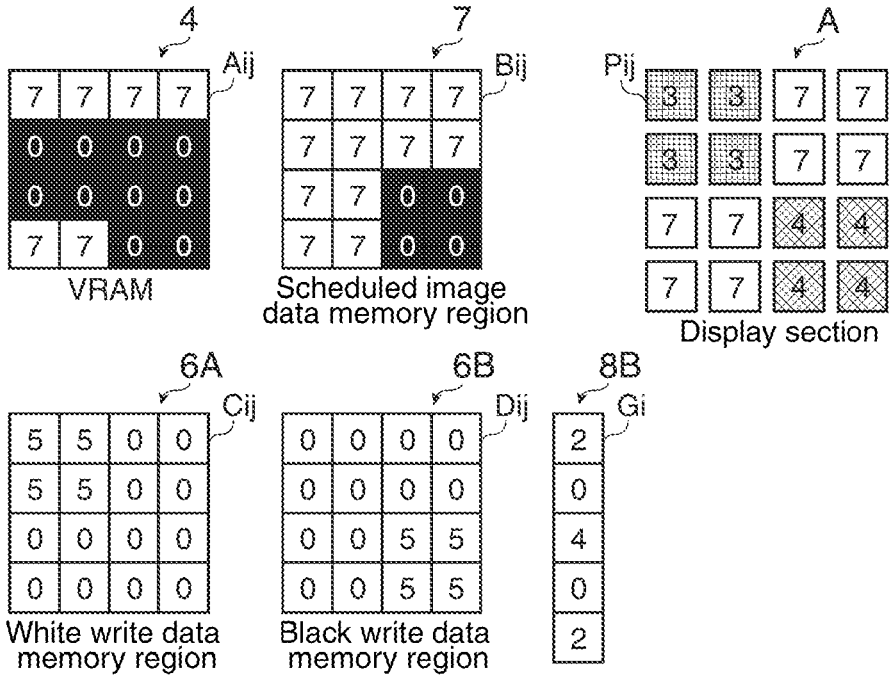
FIG. 17 shows diagrams for describing operations of the display device 100.
Figure 18:
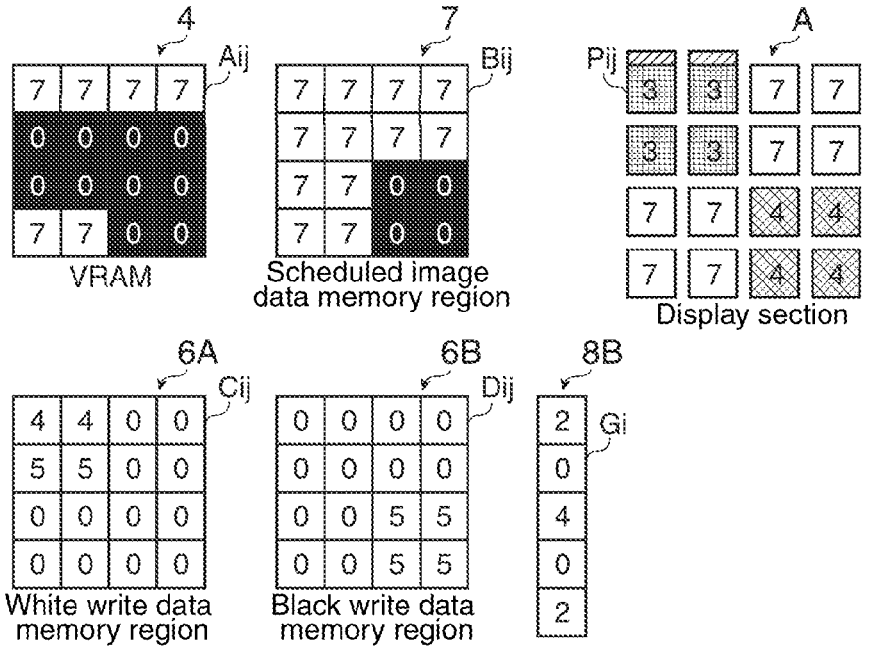
FIG. 18 shows diagrams for describing operations of the display device 100.

FIG. 16 shows a state immediately after the process in step SA6 has been executed twice since the state shown in FIG. 15. Here, a case where the contents of the VRAM 4 are rewritten as shown in FIG. 17 is considered. As the process is advanced from the state shown in FIG. 17 up to a point where a judgment YES is made in step SB8 at i=1, the contents of the memory regions assume a state shown in FIG. 18. As the process in step SB10 is executed, hatched portions in the image A in FIG. 18 are specified as portions where power is consumed, and the contents of the memory regions G1 and G2 remain the same as shown in FIG. 18.

Here, the total of the values stored in the boundary number memory region 8B is 8, such that a judgment NO is made in step SB11, and the process proceeds to step SA4. Next, as the process is advanced with i=2, and when the pixel P21 is selected in step SB2, a judgment NO is made in step SB3, and 1 is deducted from the value written to the memory region C21 in step SB4, whereby the content of the memory region C21 becomes 4. On the other hand, when the pixel P23 is selected in step SB2, a judgment YES is made in step SB3, and a judgment NO is made in step SB5. Accordingly, 7 is written to the memory region D23 in step SB6, and the content of the memory region A23 is written to the memory region B23 in step SB7. In this manner, even when contents of the VRAM 4 are rewritten from white to black, for those of the pixels in progress of being rewritten to white, the rewriting process to white is proceeded; and for those of the pixels not in progress of being rewritten to white, second write data is stored in the black write data memory region 6B. Then, as the process is advanced up to a point where a judgment YES is made in step SB8, the contents of the memory regions assume a state shown in FIG. 19.

Figure 19:
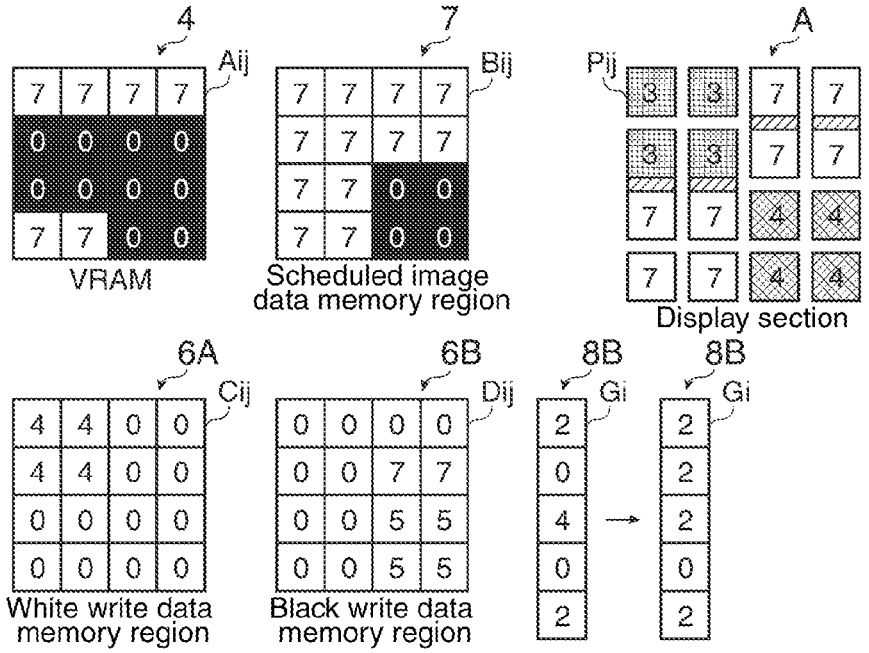
FIG. 19 shows diagrams for describing operations of the display device 100.

Next, the controller 2 executes the process in step SB10. As the memory regions C21 and C22 store 4, and the memory regions C31 and C32 store 0, the controller 2 specifies the memory regions C21 and C22. Also, as the memory regions D23 and D24 store 7, and the memory regions C13 and C14 store 0, the controller 2 specifies the memory regions C23 and C24. Here, hatched portions between the first row and the second row in the image A of FIG. 19 are specified as portions where power is consumed. The controller 2 stores the number of the specified portions "2" in the memory region G2. Also, hatched portions between the second row and the third row in the image A of FIG. 19 are specified as portions where power is consumed. The controller 2 stores the number of the specified portions "2" in the memory region G3. Here, the contents of the boundary number memory region 8B are changed, wherein the contents in the memory region G2 and the memory region G3 are changed, as shown in FIG. 19.

Here, as the sum of the values stored in the boundary number memory region 8B at this moment is 8, a judgment NO is made in step SB11, and the process proceeds to step SA4. Then, as the process is advanced from the state shown in FIG. 19 up to a point where a judgment YES is made in step SB8 when i=3, the contents of the memory regions assume a state shown in FIG. 20.

Figure 20:
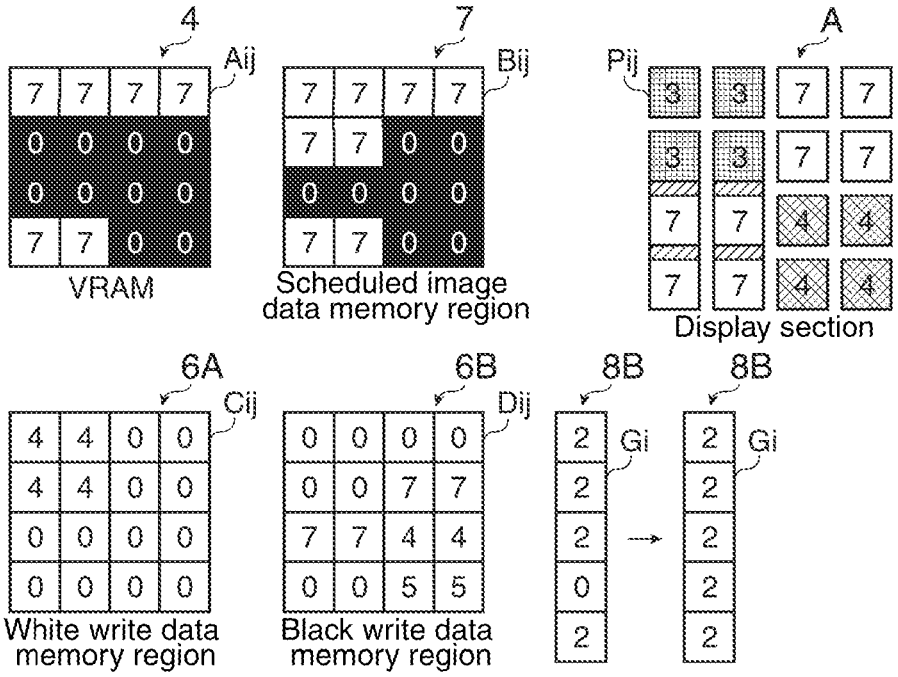
FIG. 20 shows diagrams for describing operations of the display device 100.

Here, as the process in step SB10 is executed, hatched portions between the second row and the third row in the image A of FIG. 20 are specified as portions where power is consumed. The controller 2 stores the number of the specified portions "2" in the memory region G3. Also, hatched portions between the third row and the fourth row in the image A of FIG. 20 are specified as portions where power is consumed. The controller 2 stores the number of the specified portions "2" in the memory region G4. Here, the contents of the boundary number memory region 8B are changed, wherein the contents in the memory region G3 and the memory region G4 are changed, as shown in FIG. 20.

Here, as the sum of the values stored in the boundary number memory region 8B is 10, a judgment YES is made in step SB11. When it is judged as YES in step SB11, the controller 2 stores 0 in those of the memory regions C31-C34 and the memory regions D31-D34 that store 7. Also, the memory regions B31-B34 are overwritten with the contents stored in the temporary memory region (step SB12). By this, the contents of the memory regions assume a state shown in FIG. 21. In other words, among the pixels in the third row, those of the pixels in progress of being rewritten (i.e., the pixels P33 and P34) are proceeded with rewriting process. Also, for the pixels P31 and P32 that are to be newly rewritten, their rewriting process is postponed, because the peak value of the power consumption would exceed the amount of power that can be supplied by the power supply circuit, if their rewriting is started.

Figure 21:
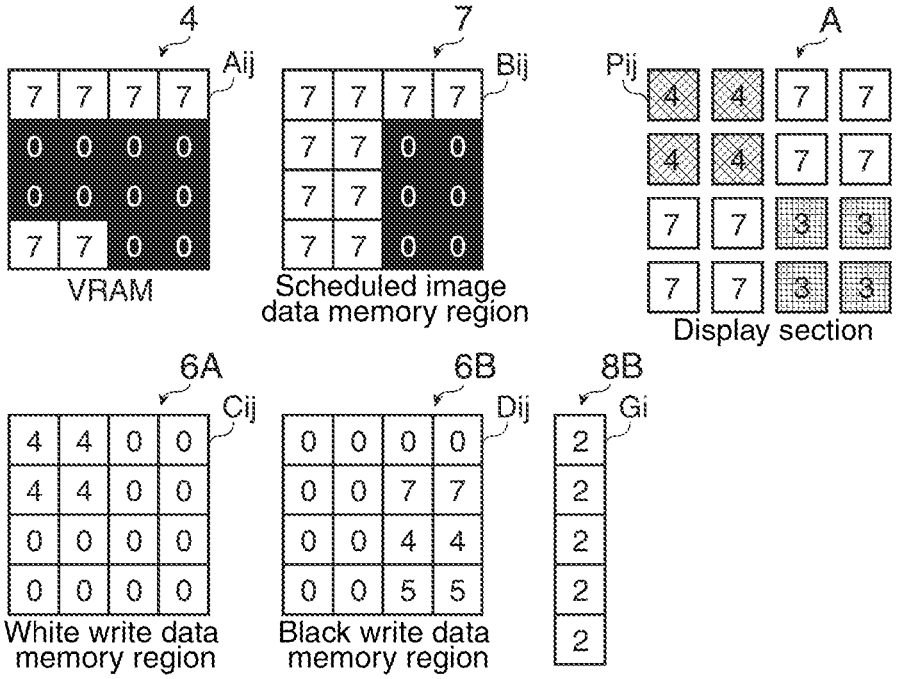
FIG. 21 shows diagrams for describing operations of the display device 100.
Figure 22:
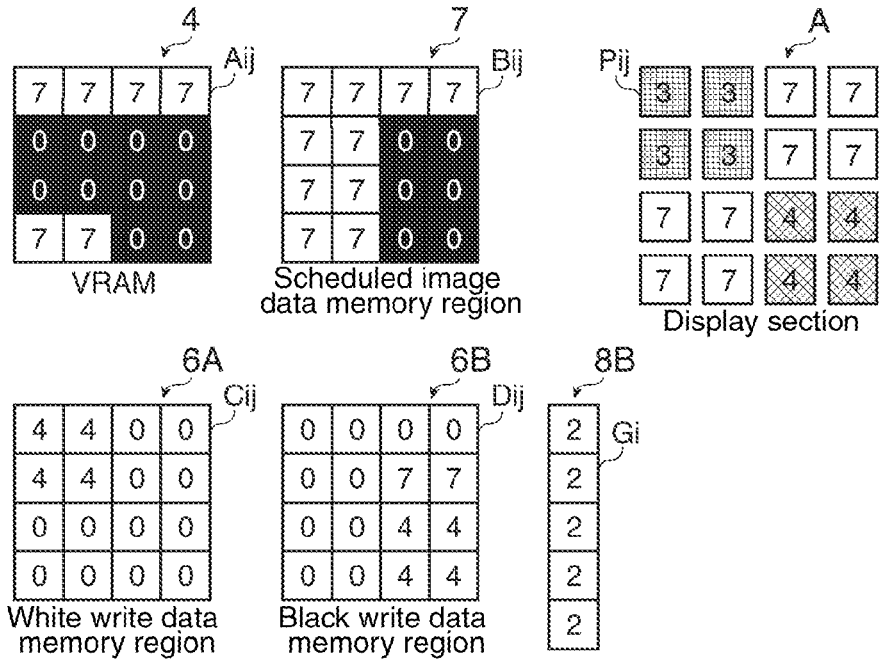
FIG. 22 shows diagrams for describing operations of the display device 100.

As the process is advanced from the state shown in FIG. 21 up to a point where a judgment YES is made in step SB8 at i=4, the contents of the memory regions assume a state shown in FIG. 22. As the process in step SB10 is executed, the content of the memory region G4 becomes 0. Then, a judgment NO is made in step SB11, and the process proceeds to step SA4.

Figure 23:
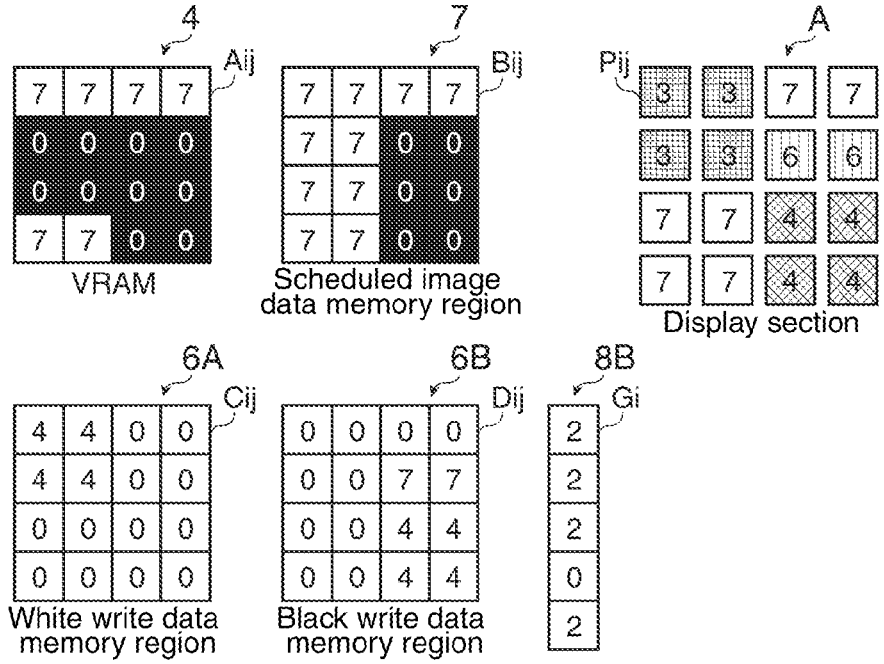
FIG. 23 shows diagrams for describing operations of the display device 100.

As the process in step SA6 is executed, the display section 1 assumes a state shown in FIG. 23, and for those of the pixels in progress of being rewritten, the ongoing rewriting process is continued. For those of the pixels that are not in the process of being rewritten, rewriting of the pixels is newly started. Also, for those of the pixels with which the peak value of the power consumption would exceed the amount of power that can be supplied by the power supply circuit if the rewriting is started, their rewriting is postponed.

Figure 24:
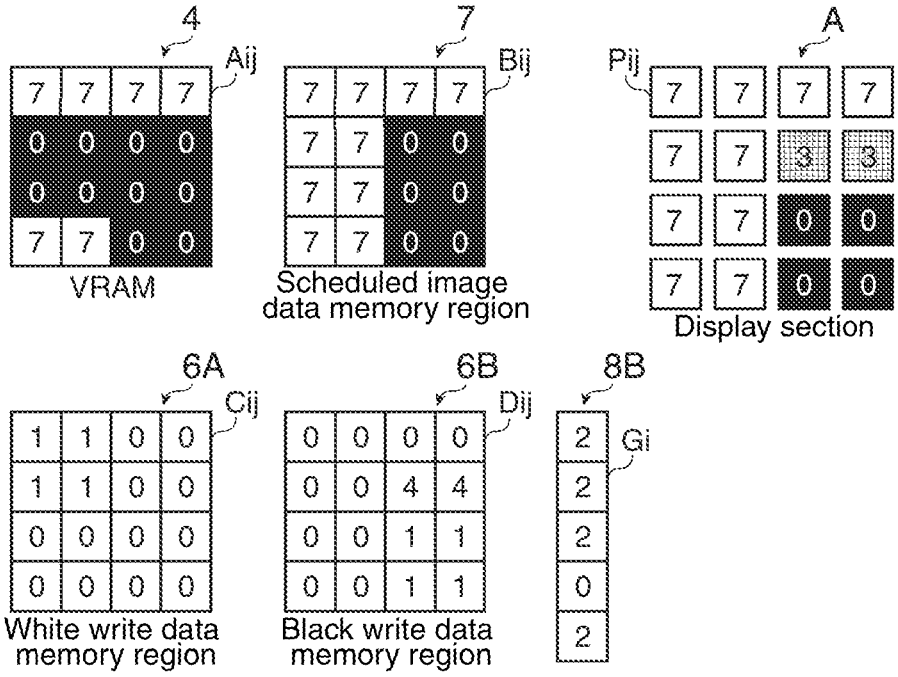
FIG. 24 shows diagrams for describing operations of the display device 100.

As the process further proceeds, and when the values of the first write data and the second write data for the pixels with which rewriting has been started earlier (i.e., the pixels P11, P12, P21, P22, P33, P34, P43 and P44) become 1, and the process in step SA6 is executed, the memory regions and the display on the display section 1 assume states shown in FIG. 24.

Figure 25:
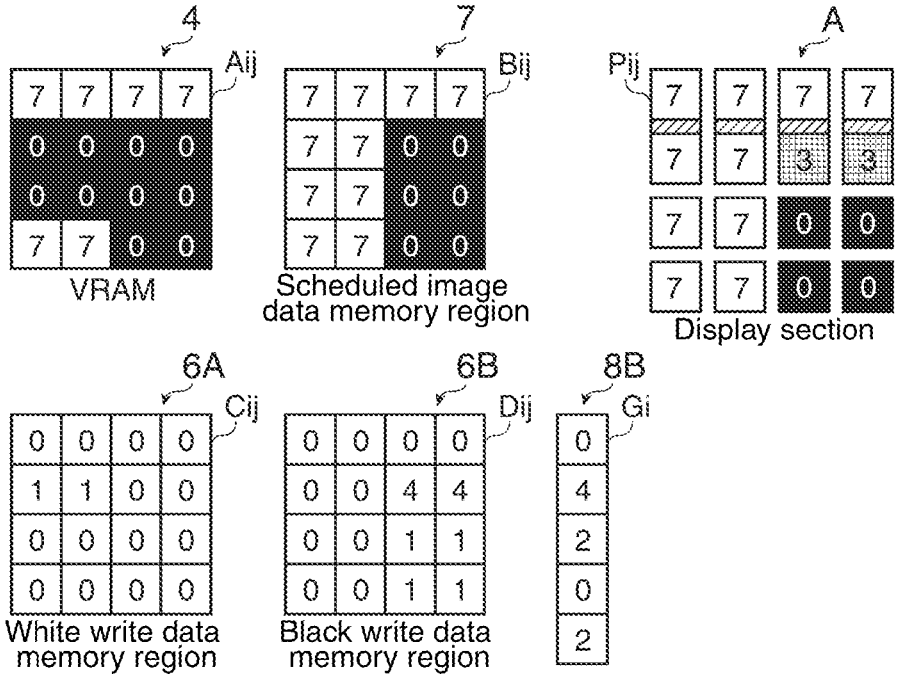
FIG. 25 shows diagrams for describing operations of the display device 100.

As the process is advanced from the state shown in FIG. 24 up to a point where a judgment YES is made in step SB8 at i=1, the contents of the memory regions C11 and C12 become 0 as shown in FIG. 25. Here, as the process in step SB10 is executed, hatched portions of the image A in FIG. 25 are specified as portions where power is consumed. The controller 2 stores the number of the specified portions "4" in the memory region G2. The content of the boundary number memory region 8B is changed to a state, as shown in FIG. 25.

Figure 26:
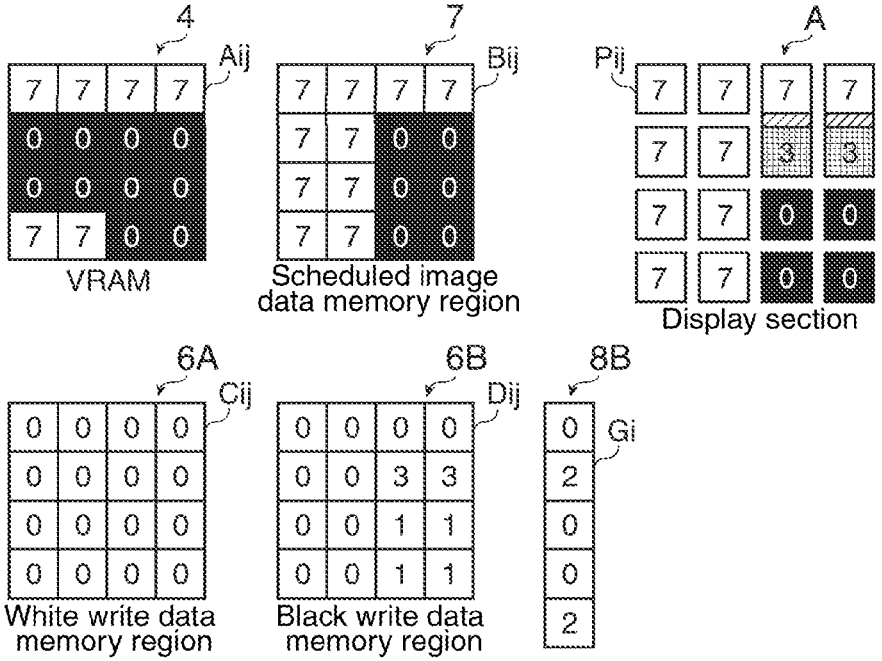
FIG. 26 shows diagrams for describing operations of the display device 100.

Since the sum of the values stored in the boundary number memory region 8B is 8, a judgment NO is made in step SB11, and the process proceeds to step SA4. As the process is advanced from the state shown in FIG. 25 up to a point where a judgment YES is made in step SB8 at i=2, the contents of the memory regions C21 and C22 become 0 as shown in FIG. 26. Here, as the process in step SB10 is executed, hatched portions of the image A in FIG. 26 are specified as portions where power is consumed. The content of the boundary number memory region 8B is changed to a state, as shown in FIG. 26.

Figure 27:
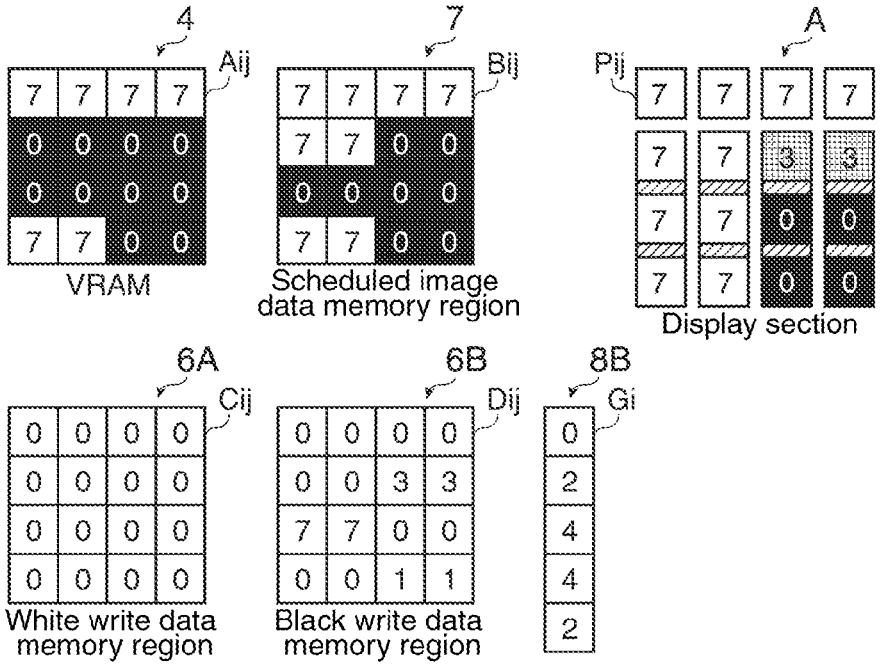
FIG. 27 shows diagrams for describing operations of the display device 100.

Since the sum of the values stored in the boundary number memory region 8B is 4 at this moment, a judgment NO is made in step SB11, and the process proceeds to step SA4. As the process is advanced from the state shown in FIG. 26 up to a point where a judgment YES is made in step SB8 at i=3, the contents of the memory regions C31 and C32 become 7 as shown in FIG. 27. Here, as the process in step SB10 is executed, hatched portions of the image A in FIG. 27 are specified as portions where power is consumed, and the contents of the memory regions G3 and G4 assume a state shown in FIG. 27.

Figure 28:
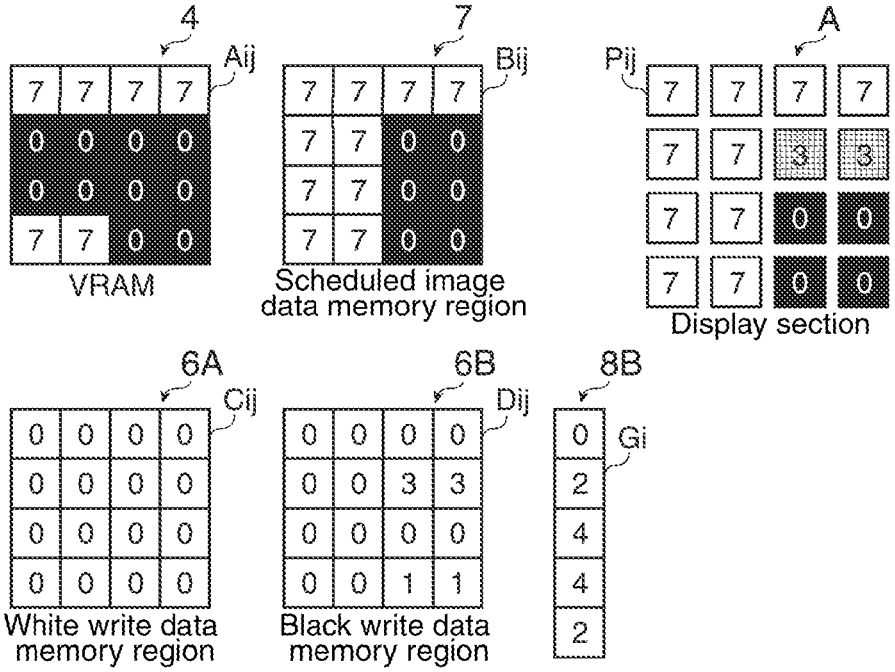
FIG. 28 shows diagrams for describing operations of the display device 100.

As the sum of the values stored in the boundary number memory region 8B is greater than 10, a judgment YES is made in step SB11, and the process in step SB12 is executed and the contents of the memory regions assume a state shown in FIG. 28.

Figure 29:
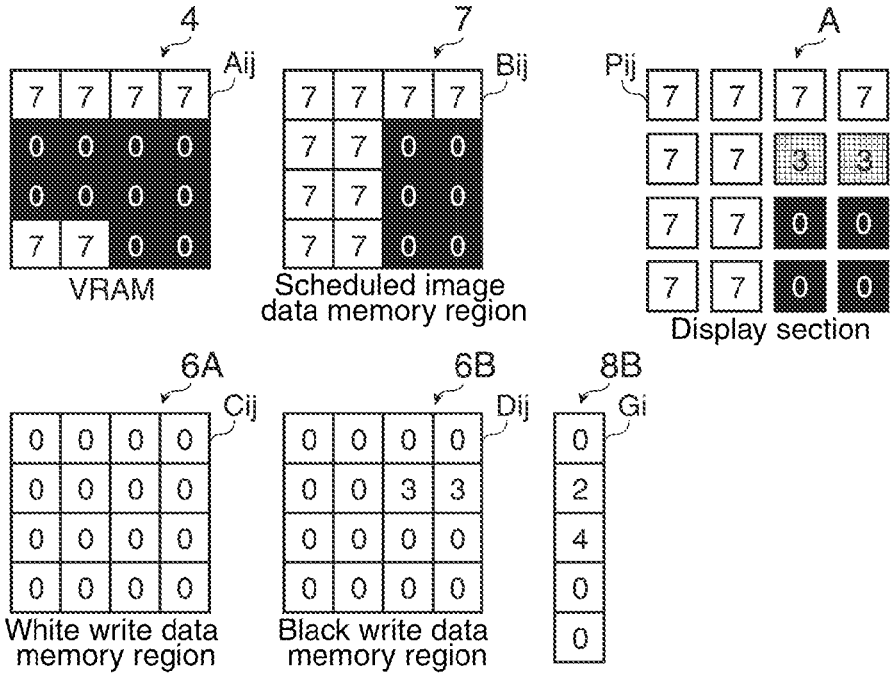
FIG. 29 shows diagrams for describing operations of the display device 100.
Figure 30:
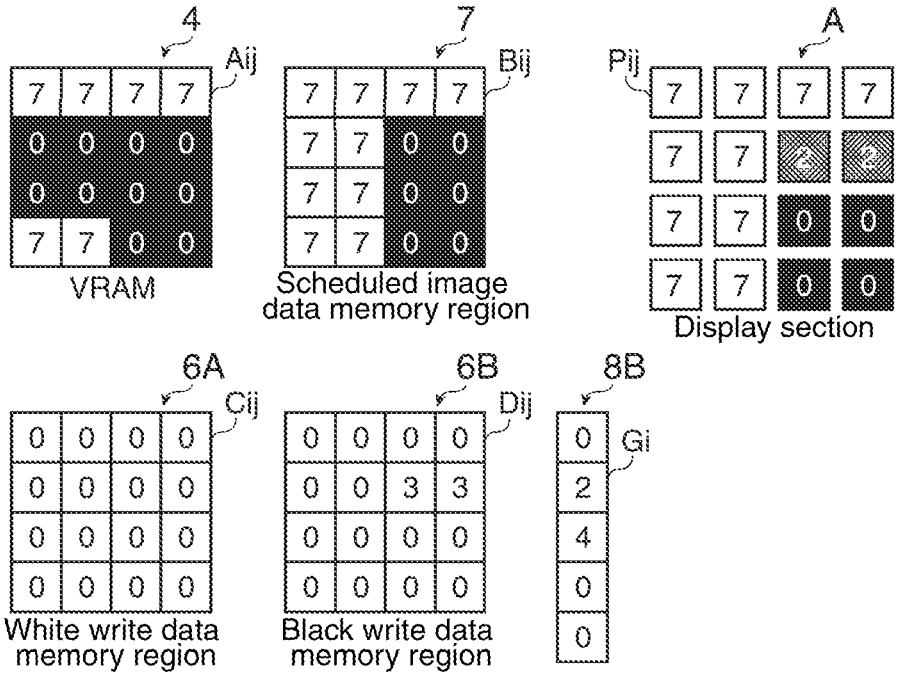
FIG. 30 shows diagrams for describing operations of the display device 100.

Thereafter, the process proceeds to step SA4, and process is advanced with i=4. As the process is advanced up to a point where a judgment YES is made in step SB8, the contents of the memory regions D43 and D44 become 0. Here, the process in step SB10 is executed. As the contents of the memory regions C41-C44 and the memory regions D41-D44 are 0, no portion whose application voltage is different from the adjacent row is specified, such that the contents of the memory regions G4 and G5 both become 0, and the contents of the memory regions assume a state shown in FIG. 29. Then, as the process in step SA6 is executed, the state of the display section 1 assumes a state shown in FIG. 30.

Thereafter, the process proceeds to step SA4, and the process is executed again with i=2. As the process is advanced up to a point where a judgment YES is made in step SB8, the contents of the memory regions assume a state shown in FIG. 31. Here, as the process in step SB10 is executed, hatched portions are specified as portions where power is consumed, and the contents of the memory regions G2 and G3 assume a state shown in FIG. 31.

Figure 31:
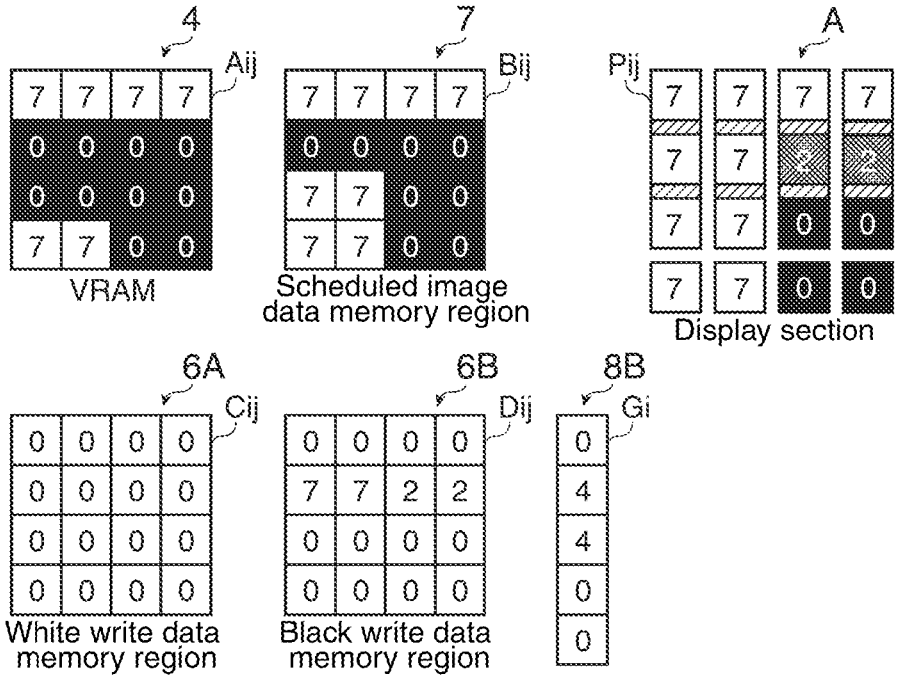
FIG. 31 shows diagrams for describing operations of the display device 100.
Figure 32:
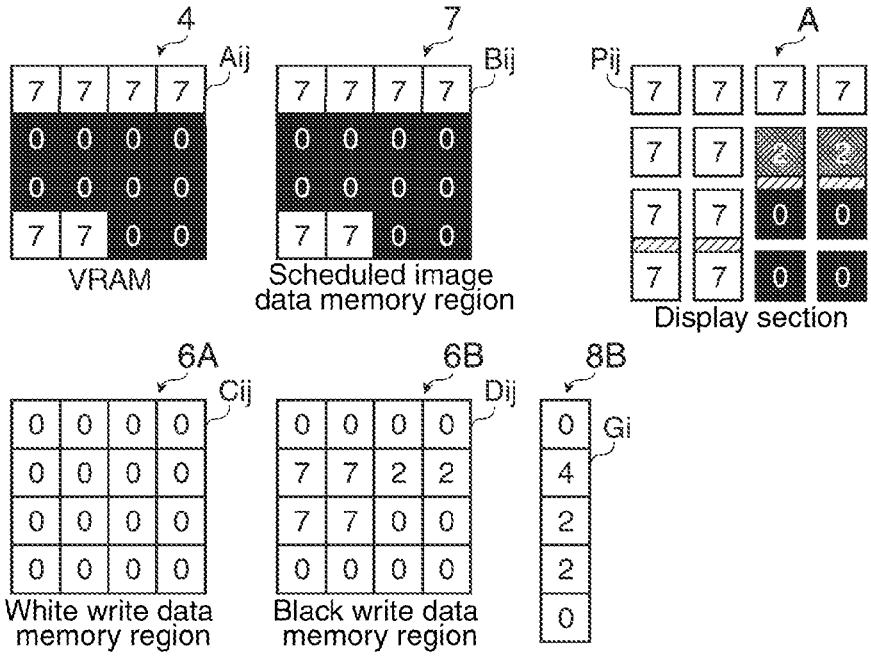
FIG. 32 shows diagrams for describing operations of the display device 100.
Figure 33:
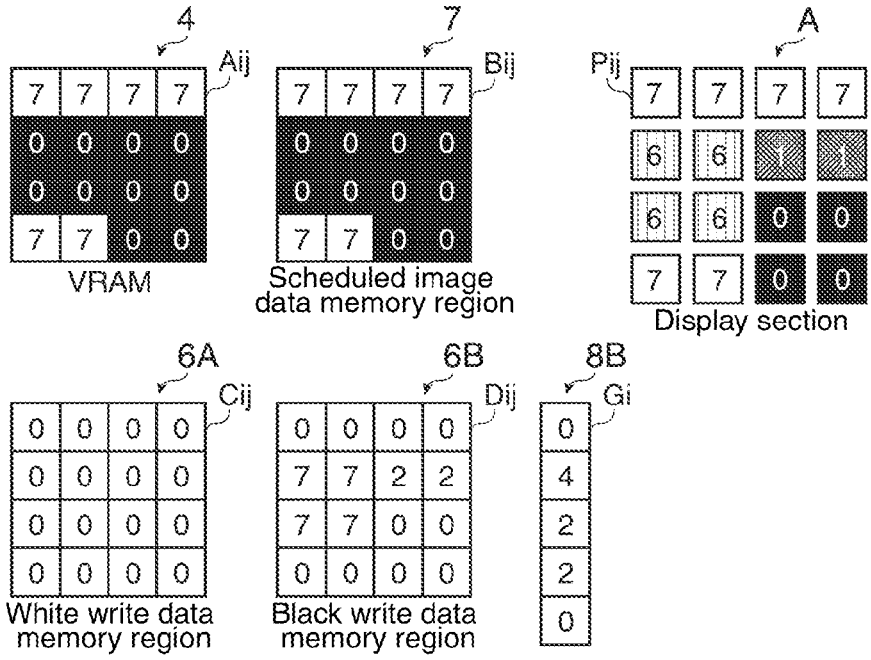
FIG. 33 shows diagrams for describing operations of the display device 100.

Further, as the process is advanced from the state shown in FIG. 31 up to a point where a judgment YES is made in step SB8 with i=3, the contents of the memory regions D31 and D32 become 7, as shown in FIG. 32. Here, as the process in step SB10 is executed, hatched portions of the image A in FIG. 32 are specified as portions where power is consumed, and the contents of the memory regions G3 and G4 assume a state shown in FIG. 32. Thereafter, as the step SA6 is executed, the memory regions assume a state shown in FIG. 33. Here, rewriting of the pixels whose rewriting has been postponed is started.

According to the present embodiment, even when a region where rewiring was started earlier and a region where rewriting is to be newly started overlap each other, rewiring is immediately started on a portion where rewiring is not in progress when the rewiring is newly started, which makes the user feel that the display speed is faster. Also, if rewriting of pixels would cause the peak value of the power consumption to exceed the amount of power that can be supplied by the power supply circuit, rewriting of the pixels is postponed. When the peak value of the power consumption lowers to a level not to exceed the amount of power that can be supplied by the power supply circuit, rewriting of the pixels whose rewriting has been postponed is resumed, such that the peak value of the power consumption at the time of rewriting pixels can be suppressed.

Second Embodiment

Figure 34:
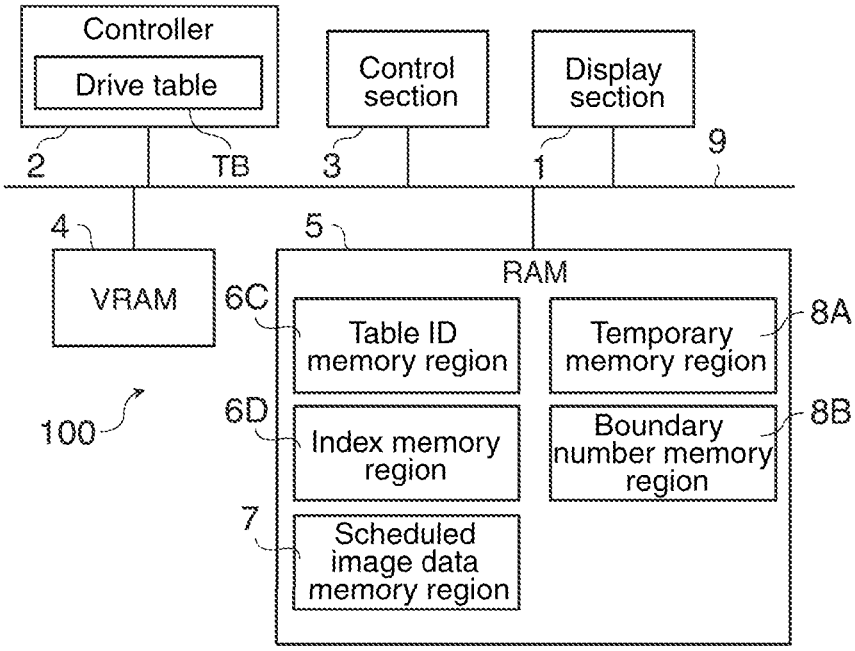
FIG. 34 is a block diagram of a hardware configuration of a display device 100A.

Next, a display device 100A in accordance with a second embodiment of the invention will be described. FIG. 34 is a diagram showing a hardware configuration of the display device 100A. It is noted that, in the following description, portions of the configuration of the display device 100A which are the same as those of the display device 100 in accordance with the first embodiment will be appended with the same reference numbers, and their description will be omitted. The display device 100A is different from the first embodiment in its operations to change the gradation of pixels. A controller 2 has a drive table TB. Also, a RAM 5 is provided with a table ID memory region 6C and an index memory region 6D.

Figure 35:
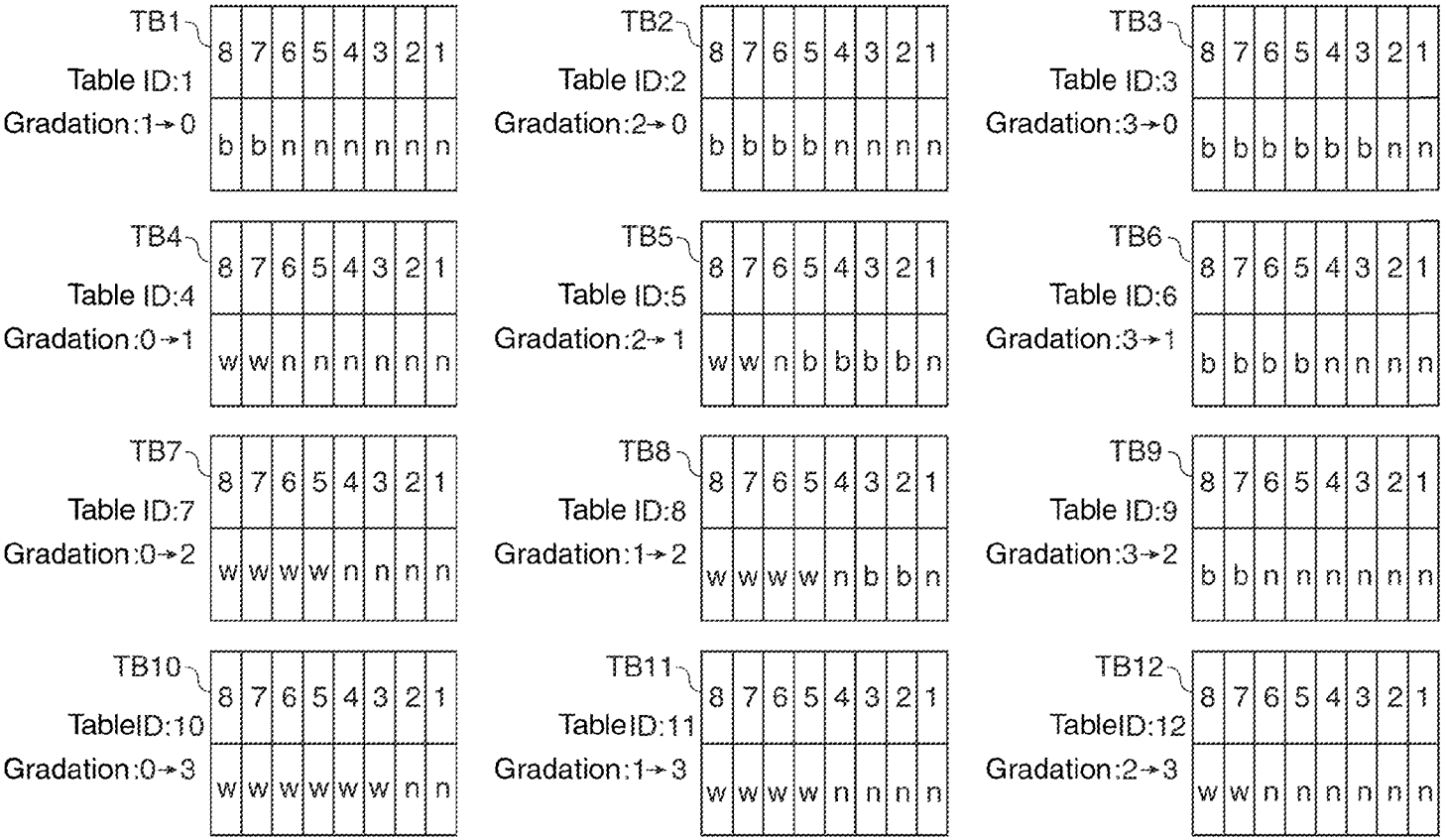
FIG. 35 shows contents of tables TB1-TB12 in accordance with a second embodiment of the invention.

FIG. 35 shows contents of the drive table TB. The drive table TB is composed of twelve tables TB1-TB12 identified by table IDs. In accordance with the present embodiment, pixels are given four levels of gradation between black and white. These levels of gradation are expressed by numbers sequentially from 0 (black) to 3 (white). An appropriate one of the tables TB1-TB12 is selected when pixels are changed from one gradation to another gradation, and the table to be selected is decided based on the gradation of the pixel before a change and the gradation of the pixel after the change. It is noted that, when the gradation of pixels is changed, the voltage is applied to the pixel electrodes 13*a* a plurality of times. Each of the tables stores data indicative of voltages to be applied to the pixel electrodes 13*a* each time the gradation of pixels is changed from one gradation to another gradation. The numbers 1-8 stored in the tables are indexes. Data "b," "w" and "n" correlated with each of the indexes are voltages to be applied to the pixel electrodes 13*a* at each voltage application. The data "b" indicates that a positive voltage causing a potential difference of +15V with respect to the transparent electrode 32 is applied to the pixel electrode 13*a*. The data "w" indicates that a negative voltage causing a potential difference of −15V with respect to the transparent electrode 32 is applied to the pixel electrode 13*a*. The data "n" indicates that a potential difference of 0V is generated between the pixel electrode 13*a* and the transparent electrode 32.

Next, the flow of processes performed by the display device 100A and the operation of the display device 100A will be described. Figures illustrating contents of the memory regions in the drawings relating to the description of the second embodiment show, in addition to the contents of the VRAM4 and the scheduled image data memory region 7, contents of memory regions Eij in the table ID memory region 6C corresponding to pixels P11-P44, and contents of memory regions Fij in the index memory region 6D corresponding to pixels P11-P44. The memory regions E11-E44 store table IDs of those of the tables to be used at the time of changing the gradation of pixels. For example, when 1 is stored as the table ID, the table TB1 whose table ID is 1 is used at the time of changing the gradation of the pixels. The memory regions F11-F44 store numbers indicative of which indexes are to be referred to in the tables.

Figure 36:
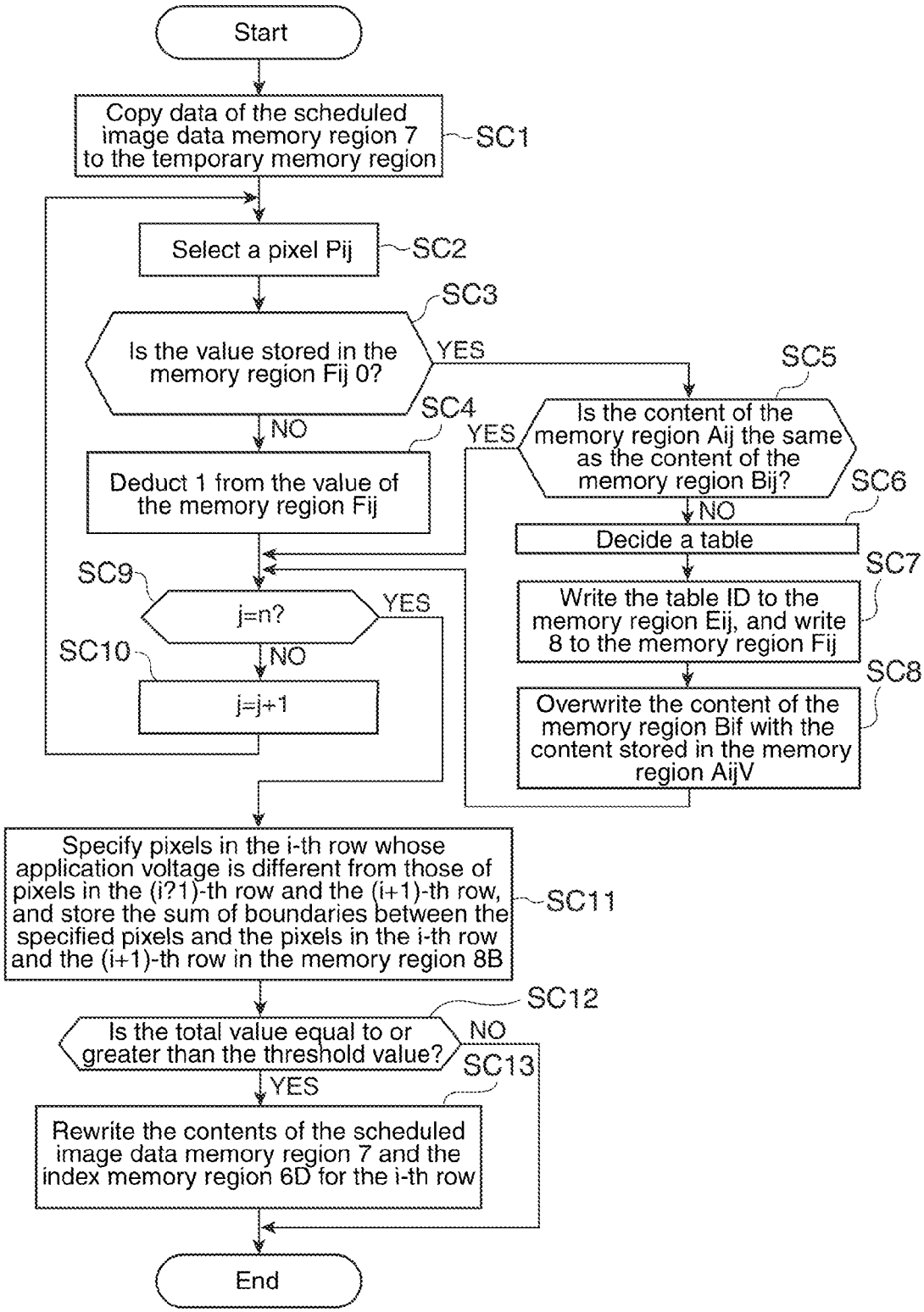
FIG. 36 is a flow chart of processes performed by a controller 2 in accordance with the second embodiment.

The controller 2 in accordance with the present embodiment is different from the first embodiment in process contents in step SA3. FIG. 36 is a flow chart of process contents of step SA3 in the present embodiment. The processes in step SC1-step SC2 are the same as those of step SB1-SB2 in accordance with the first embodiment. Next, the controller 2 judges as to whether or not the value of the index stored in the memory region Fij corresponding to the selected pixel Pij is 0 (step SC3). The controller 2 proceeds to step SC5 when the content of the memory region Fij is 0 (YES in step SC3), and proceeds to step SC4 when it is other than 0 (NO in step SC3). In step SC4, the controller deducts 1 from the value of the memory region Fij.

In step SC5, the controller 2 compares the data stored in the memory region Aij and the data stored in the memory region Bij. When they differ from each other (NO in step SC5), the controller 2 determines to select one of the tables TB1-TB12 to be used for changing the gradation of the pixel from the gradation stored in the memory region Bij to the gradation stored in the memory region Aij (step SC6). Next, the controller 2 writes the table ID of the table decided in step SC6 to the memory region Eij, and writes 8 to the memory region Fij (step SC7). Also, the controller 2 overwrites the content in the memory region Bij with the content stored in the memory region Aij (step SC8).

Processes in the succeeding steps SC9 and SC10 are the same as the processes in steps SB8 and SB9 of the first embodiment. The controller 2 specifies, in step SC11, at each of the columns, pixels among the pixels in the i-th row with which a voltage that is different from a voltage applied to pixels in the (i−1)-th row is applied, and stores the sum of boundaries between the specified pixels and the pixels in the (i−1)-th row in the memory region Gi. Also, the controller 2 specifies, at each of the columns, pixels among the pixels in the i-th row with which a voltage that is different from a voltage applied to pixels in an (i+1)-th row is applied, and stores the sum of boundaries between the specified pixels and the pixels in the (i+1)-th row in the memory region Gi+1.

Next, the controller 2 sums up the values stored in the boundary number memory region 8B, and judges as to whether or not the sum is equal to or greater than a predetermined threshold value (step SC12). When the sum is less than the threshold value (NO in step SC12), the controller 2 proceeds to step SA4. On the other hand, when the sum is equal to or greater than the threshold value (YES in step SC12), the controller 2 rewrites the contents of the memory regions in i-th row (step SC13).

Next, referring to the drawings, an example of the operation to drive the pixels will be described. It is noted that the description will be made while assuming a state in which image data are written to the VRAM 4 as shown in FIG. 37.

Figure 37:
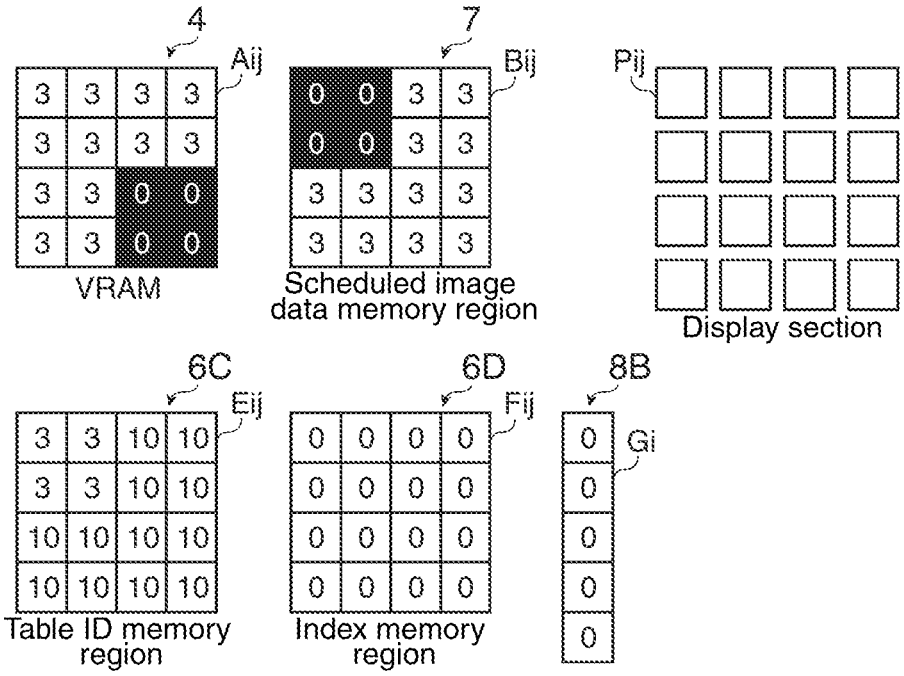
FIG. 37 shows diagrams for describing operations of the display device 100A.

When the process in step SA3 is executed in the state shown in FIG. 37, and the pixel P11 is selected in step SC2, a judgment YES is made in step SC3, and a judgment NO is made in step SC5. In the next step SC6, because the content of the memory region B11 is 0 and the content of the memory region A11 is 3, the table TB10 for changing the gradation from 0 to 3 is determined as a table to be used for changing the gradation of the pixel P11. Next, the table ID of the table decided in step SC6 is written to the memory region E11, 8 is written to the memory region F11 (step SC7), and the content of the memory region B11 is overwritten with the content of the memory region A11 (step SC8). Next, when the pixel P12 is selected, a judgment YES is made in step SC3, and a judgment NO is made in step SC5. Thereafter, the table TB10 is determined, the table ID is written to the memory region E12, 8 is written to the memory region F12 (step SC7), and the content of the memory region B1 is overwritten with the content of the memory region A12 (step SC8). Here, the contents of the memory regions assume a state shown in FIG. 38.

Thereafter, the process is advanced up to a point where a judgment YES is made in step SC9, the controller 2 executes the process in step SC11. The controller 2 refers to the memory regions Eij and the memory regions Fij for the pixels in the i-th row, and specifies voltages to be applied to the respective pixels. Next, the controller 2 refers to the table ID memory region 6C and the index memory region 6D for pixels in the (i−1)-th row, and specifies voltages to be applied to the respective pixels. Also, the controller 2 refers to the table ID memory region 6C and the index memory region 6D for pixels in the (i+1)-th row, and specifies voltages to be applied to the respective pixels. Then, the controller 2 specifies pixels among the pixels in the i-th row with which a voltage that is different from a voltage applied to pixels in the (i−1)-th row is applied, and specifies boundaries at the specified pixels with respect to the (i−1)-th row. The specified boundary portions are portions that consume power, as described in the first embodiment. Also, the controller 2 specifies pixels among the pixels in the i-th row with which a voltage that is different from a voltage applied to pixels in an (i+1)-th row is applied, and specifies boundaries at the specified pixels with respect to the (i+1)-th row. The specified boundary portions are portions that consume power, as described in the first embodiment.

Figure 38:
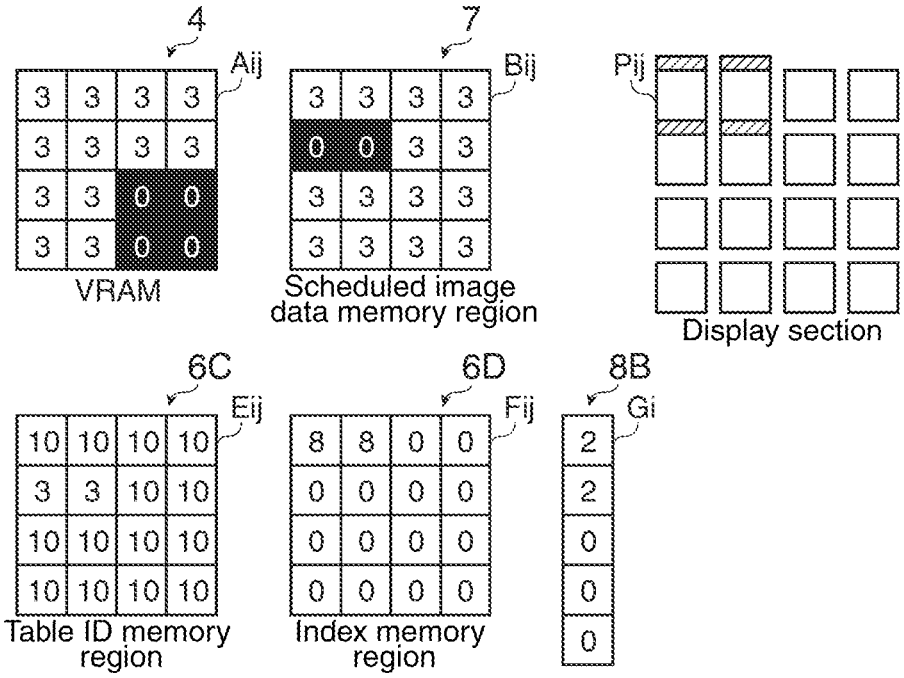
FIG. 38 shows diagrams for describing operations of the display device 100A.

For example, in the state shown in FIG. 38, a negative voltage is applied to the pixel electrodes 13*a* at the pixels P11 and P12 so as to generate a potential difference of −15V with respect to the transparent electrode layer 32, and a voltage is applied to the pixel electrodes 13*a* at the pixels P21 and P22 so as to cause a potential difference of 0V with respect to the transparent electrode layer 32. Different voltages are applied to the pixel electrodes 13*a* at the pixel P11 and the pixel P21, respectively, and different voltages are applied to the pixel electrodes 13*a* at the pixel P12 and the pixel P22, respectively. Therefore the controller 2 specifies a boundary portion between the pixels P11 and P21 and a boundary portion between the pixels P12 and P22 (hatched portions in the image Pij between the first row and the second row in FIG. 38) as portions where power is consumed. Also, the controller 2 specifies hatched portions in the display section in FIG. 38 above the first row as portions where power is consumed. As the controller 2 stores the number of the specified boundary portions in the memory region Gi and the memory region Gi+1, the contents of the boundary number memory region 8*b* assumes a state shown in FIG. 38.

Next, the controller 2 judges as to whether the sum of the values stored in the boundary number memory region 8B is equal to or greater than a predetermined threshold value (step SC12). If the threshold value is 10, like the first embodiment, a judgment NO is made in step SC12 as the sum of the values stored in the boundary number memory region 8B at this moment is 4, and therefore the process proceeds to step SA4.

Figure 39:
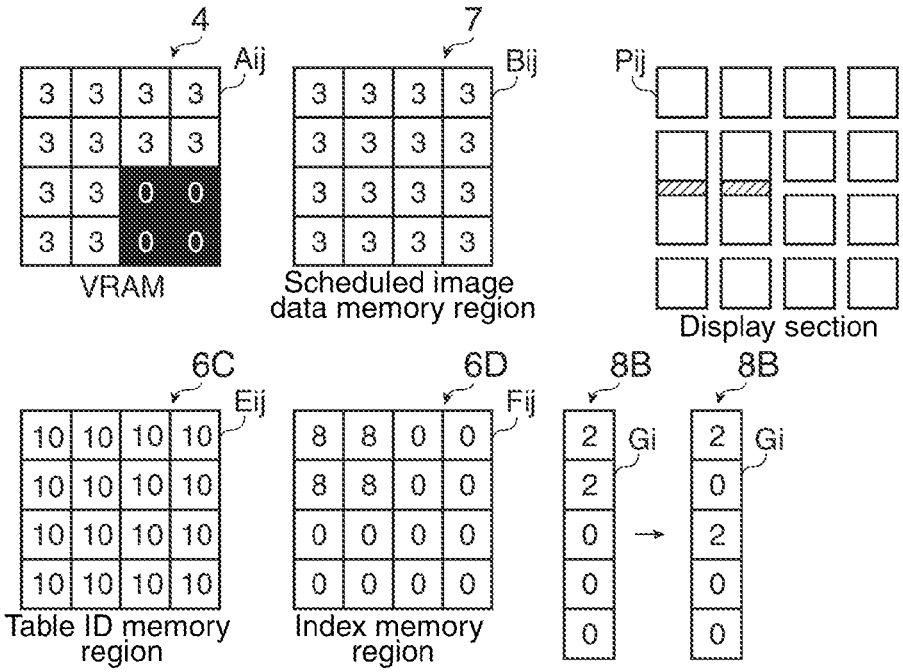
FIG. 39 shows diagrams for describing operations of the display device 100A.

Then, as the process in step SA5 is executed where i is set to 2 (i=2), and when the process is advanced up to a point where a judgment YES is made in step SC9, the contents in the memory regions assume a state shown in FIG. 39. Here, as the process in step SC11 is executed, hatched portions in the display section in FIG. 39 are specified as portions where power is consumed. The controller 2 stores the number of the specified portions "2" in the memory region G3. Here, the content of the boundary number memory region 8B is changed to a state, as shown in FIG. 39, wherein 2 is stored in the memory region G3. It is noted that, because no specified portion exists between the first row and the second row, 0 is stored in the memory region G2.

Figure 40:
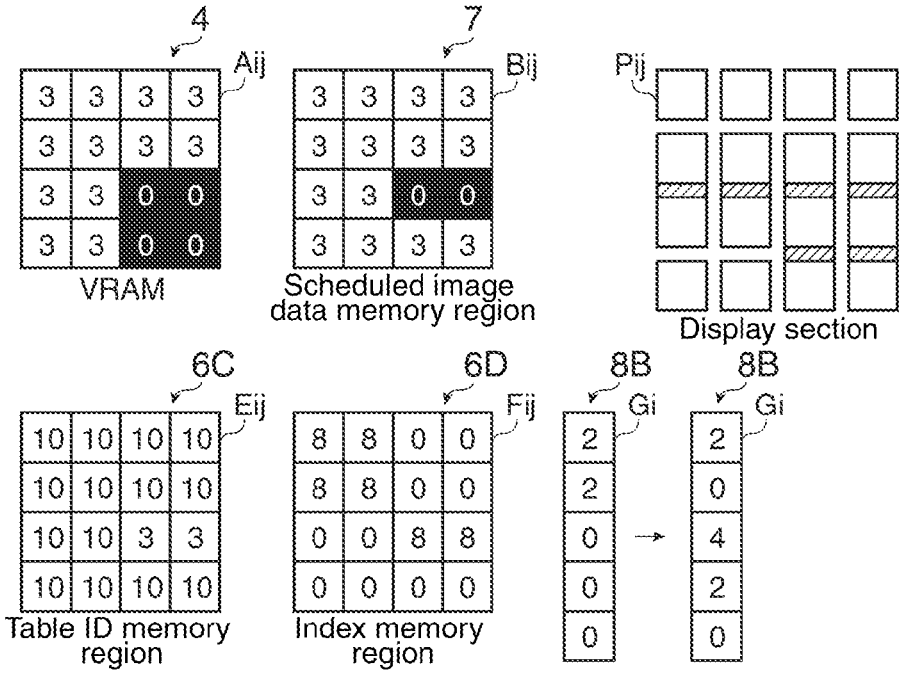
FIG. 40 shows diagrams for describing operations of the display device 100A.

Then, as the process in step SA5 is executed where i is set to 3 (i=3), and when the process is advanced up to a point where a judgment YES is made in step SC9, the contents in the memory regions assume a state shown in FIG. 40. Here, as the process in step SC11 is executed, hatched portions in the display section in FIG. 40 are specified as portions where power is consumed. The controller 2 stores the numbers of the specified portions in the memory regions G3 and G4. Here, the contents of the boundary number memory region 8B assume a state as shown in FIG. 40, where 4 is stored in the memory region G3, and 2 is stored in the memory region G4. Then, the controller 2 executes the process in step SC12. As the sum of the values stored in the boundary number memory region 8B at this moment is 8, a judgment NO is made in step SC12, and the process proceeds to step SA4.

Figure 41:
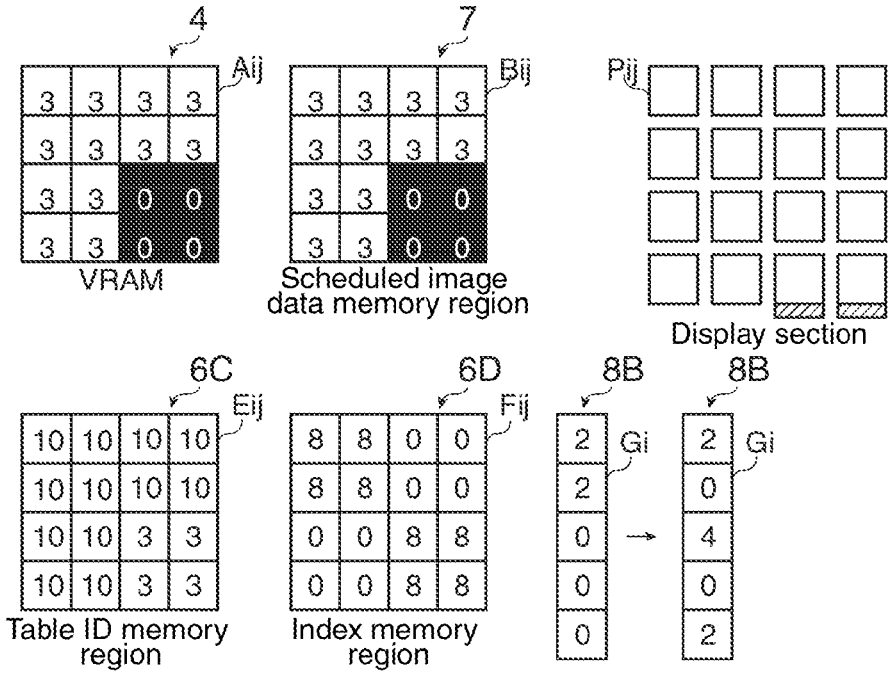
FIG. 41 shows diagrams for describing operations of the display device 100A.

Then, as the process in step SA5 is executed where i is set to 4 (i=4), and when the process is advanced up to a point where a judgment YES is made in step SC9, the contents in the memory regions assume a state shown in FIG. 41. Here, as the process in step SC11 is executed, hatched portions in the display section in FIG. 41 are specified as portions where power is consumed. The controller 2 stores the numbers of the specified portions in the memory regions G4 and G5. Here, the contents of the boundary number memory region 8B assume a state as shown in FIG. 41, where 0 is stored in the memory region G4, and 2 is stored in the memory region G5.

As the process is further advanced, the process in step SA6 is executed. Here, the table ID stored in the memory region E11 for the pixel P11 is 10, and the index stored in the memory region F11 is 8. For the pixel P11, data correlated with the index 8 in the table TB10 is "w." Therefore, the pixel drive circuit is driven such that the pixel electrode 13*a* has a potential of −15V with respect to the transparent electrode 32. Also, the table ID stored in the memory region E33 for the pixel P33 is 3, and the index stored in the memory region F11 is 8. For the pixel P33, data correlated with the index 8 in the table TB3 is "b." Therefore, the pixel drive circuit is driven such that the pixel electrode 13*a* has a potential of +15V with respect to the transparent electrode 32. For the pixels corresponding to the memory regions whose index is 0, the transparent electrode 32 and the pixel electrodes 13*a* are given a potential difference of 0V.

Figure 42:
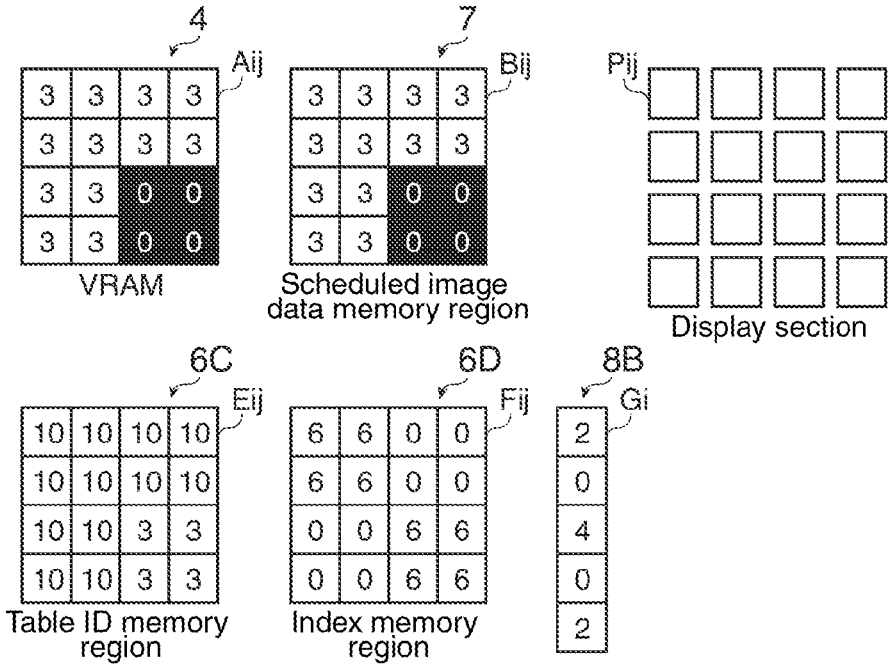
FIG. 42 shows diagrams for describing operations of the display device 100A.
Figure 43:
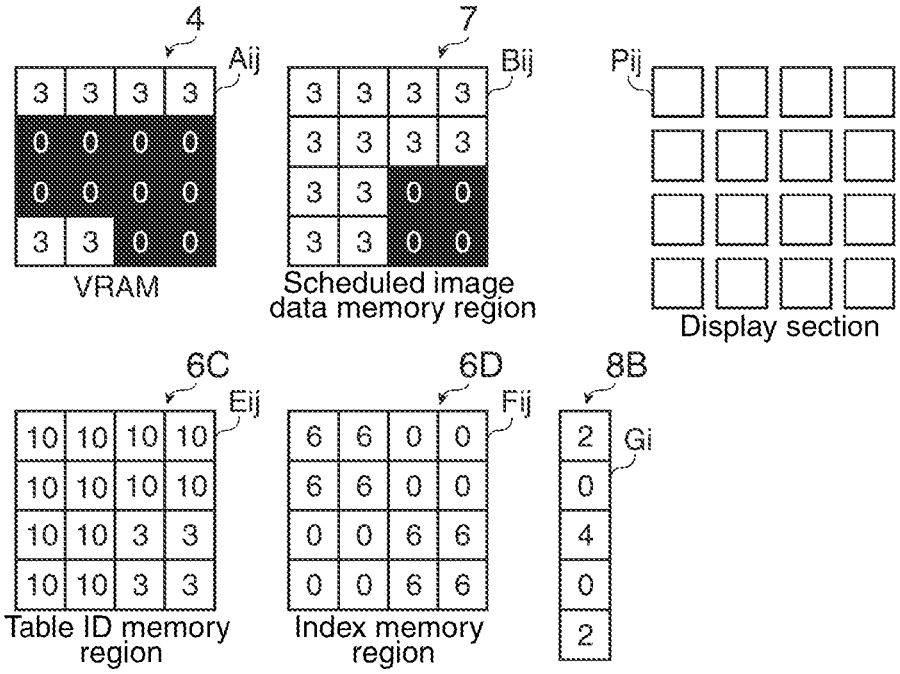
FIG. 43 shows diagrams for describing operations of the display device 100A.
Figure 44:
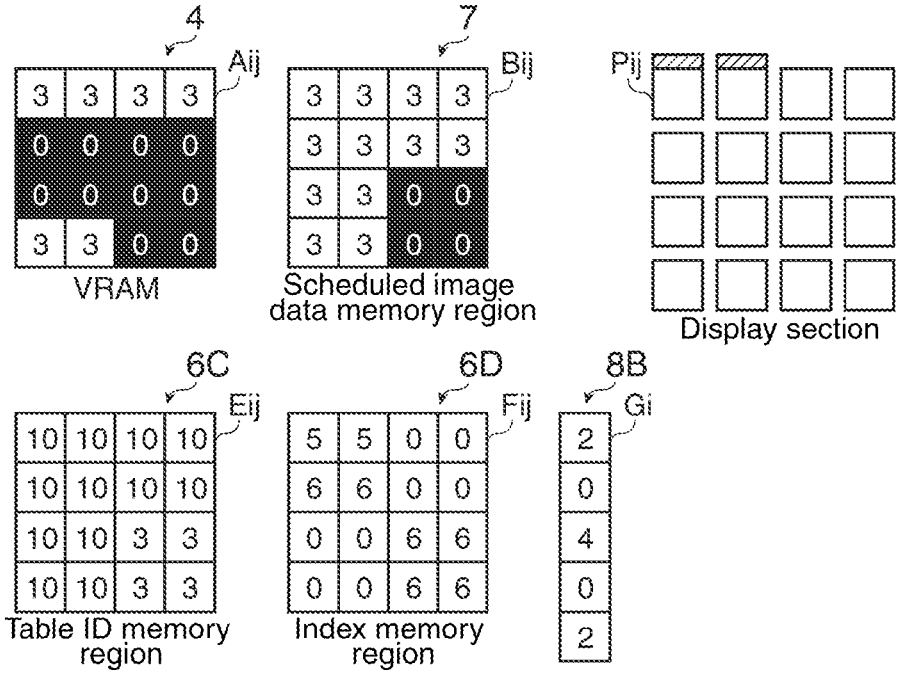
FIG. 44 shows diagrams for describing operations of the display device 100A.

FIG. 42 shows a state immediately after the process in step SA6 has been executed twice since the state shown in FIG. 41. Here, a case where the contents of the VRAM 4 are rewritten as shown in FIG. 43 is considered. As the process is advanced from the state shown in FIG. 43 up to a point where a judgment YES is made in step SC9 with i=1, the contents of the memory regions assume a state shown in FIG. 44. As the process in step SC11 is executed, hatched portions in the display section in FIG. 44 are specified as portions where power is consumed, and the contents of the memory regions G1 and G2 assume a state shown in FIG. 44.

Here, the sum of the values stored in the boundary number memory region 8B is 8, such that a judgment NO is made in step SC12, and the process proceeds to step SA4. Next, as the process is advanced with i=2, and when the pixel P21 is selected in step SC2, a judgment NO is made in step SC3, and 1 is deducted from the value written to the memory region F21 in step SC2, whereby the content of the memory region F21 becomes 5. On the other hand, when the pixel P23 is selected in step SC2, a judgment YES is made in step SC3, and a judgment NO is made in step SC5. Accordingly, in step SC7, 8 is written to the memory region F23, and 3 is written to the memory region E23. Also, in step SC8, the content of the memory region A23 is written to the memory region B23. In this manner, even when contents of the VRAM 4 are rewritten from white to black, for those of the pixels in progress of being rewritten to white, the rewriting to white is proceeded; and for those of the pixels not in progress of being rewritten, data are newly written to the corresponding ones of the memory regions Eij and the memory regions Fij. Then, as the process is advanced up to a point where a judgment YES is made in step SC9, the contents of the memory regions assume a state shown in FIG. 45.

Figure 45:
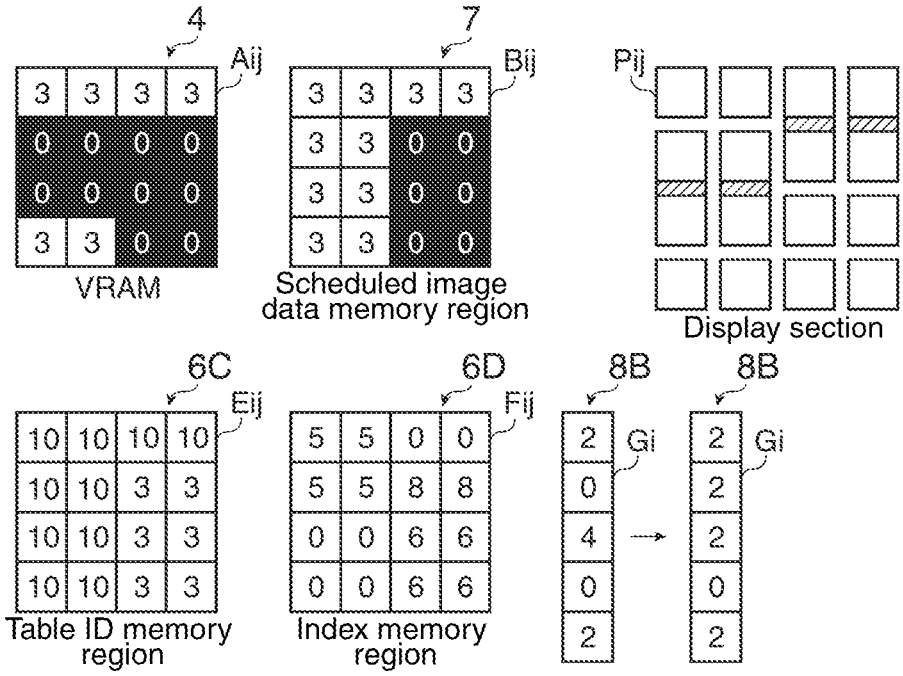
FIG. 45 shows diagrams for describing operations of the display device 100A.

As the process in step SC11 is executed, hatched portions in the display section in FIG. 45 are specified as portions where power is consumed. The controller 2 stores the numbers of the specified portions in the memory regions G2 and G3. Here, the contents of the boundary number memory region 8B assume a state wherein the contents of the memory region G2 and the memory region G3 are changed, as shown in FIG. 45.

Figure 46:
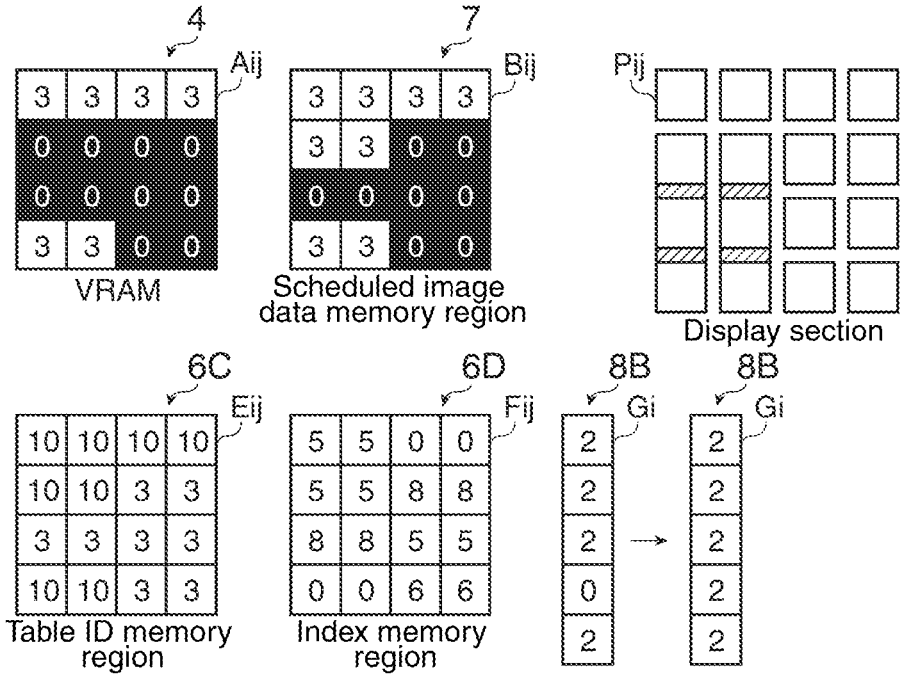
FIG. 46 shows diagrams for describing operations of the display device 100A.

Here, the sum of the values stored in the boundary number memory region 8B is 8 at this moment, such that a judgment NO is made in step SC12, and the process proceeds to step SA4. Then, as the process is advanced with i=2 up to a point where a judgment YES is made in step SC9, the contents of the memory regions assume a state shown in FIG. 46. Here, as the process in step SC11 is executed, hatched portions in the display section in FIG. 46 are specified as portions where power is consumed. The controller 2 stores the numbers of the specified portions in the memory regions G3 and G4. Here, the contents of the boundary number memory region 8B assume a state wherein the contents of the memory region G3 and the memory region G4 are changed, as shown in FIG. 46.

Here, the sum of the values stored in the boundary number memory region 8B is 10, such that a judgment YES is made in step SC12. When a judgment YES is made in step SC12, the controller 2 stores 0 in those memory regions F31-F34 where 8 is stored. Also, the memory regions B31-B34 are overwritten with the contents stored in the temporary memory region (step SC13). By this process, the contents of the memory regions assume a state shown in FIG. 47. In other words, among the pixels in the third row, those of the pixels in progress of being rewritten (i.e., the pixels P33 and P34) are proceeded with rewriting process. Also, for the pixels P31 and P32 that are to be newly rewritten, their rewriting process is postponed, because the peak value of the power consumption would exceed the amount of power that can be supplied by the power supply circuit, if their rewriting is started.

Figure 47:
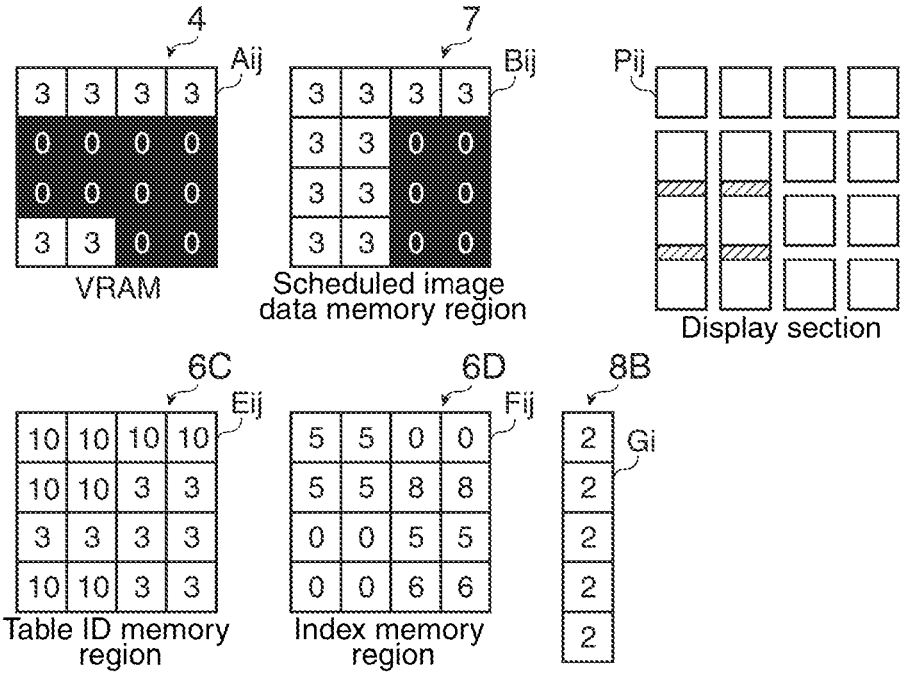
FIG. 47 shows diagrams for describing operations of the display device 100A.
Figure 48:
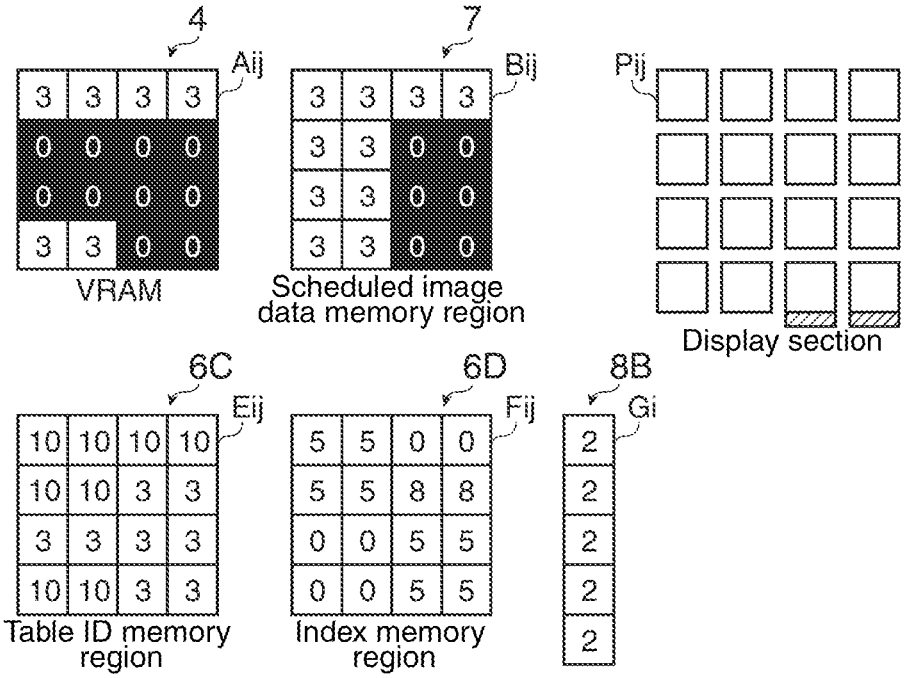
FIG. 48 shows diagrams for describing operations of the display device 100A.

As the process is advanced from the state shown in FIG. 47 up to a point where a judgment YES is made in step SC9 at i=4, the contents of the memory regions assume a state shown in FIG. 48. As the process in step SC11 is executed, the content of the memory region G4 becomes 0. Then, a judgment NO is made in step SC12, and the process proceeds to step SA4.

Then, as the process in step SA6 is executed, among the pixels corresponding to portions where the contents are rewritten in the VRAM 4, for those of the pixels in progress of being rewritten, the ongoing rewriting process is advanced. For those of the pixels not in progress of being rewritten, rewriting of the pixels is newly started. Also, for those of the pixels with which the peak value of the power consumption would exceed the amount of power that can be supplied by the power supply circuit if rewriting is started, rewriting of the pixels would not be started.

Figure 49:
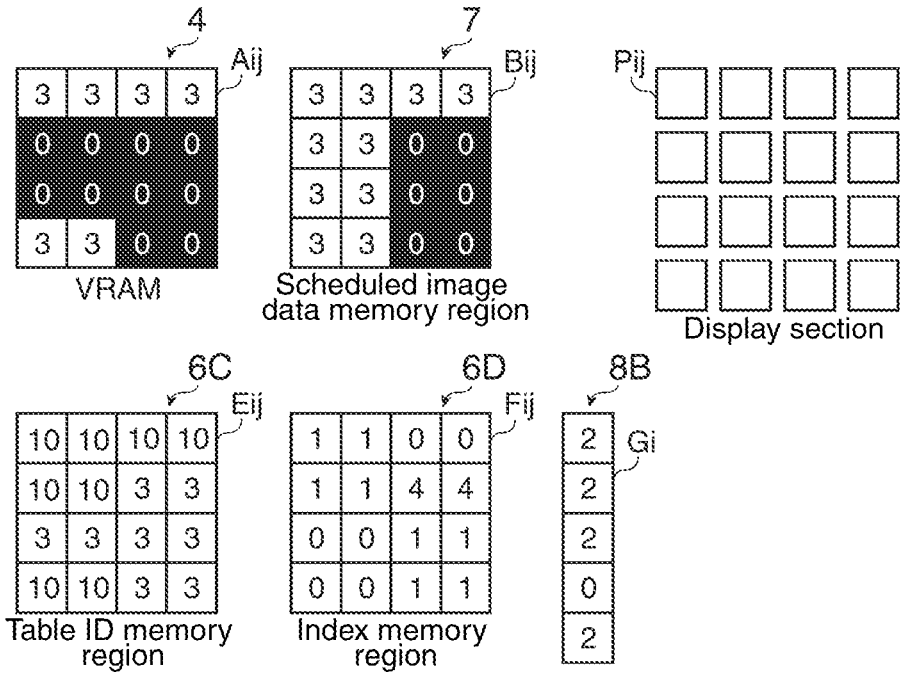
FIG. 49 shows diagrams for describing operations of the display device 100A.
Figure 50:
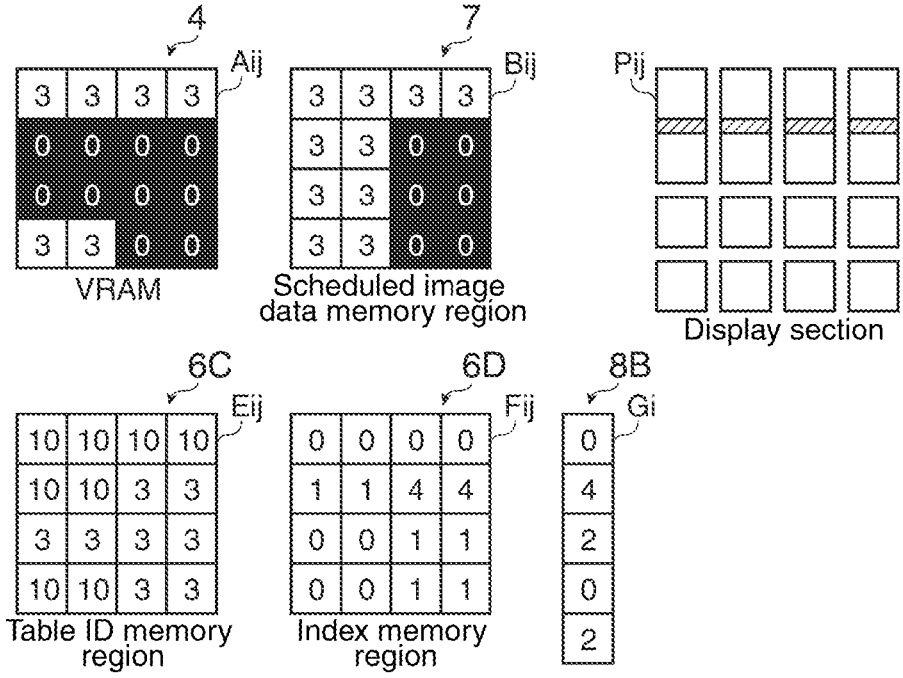
FIG. 50 shows diagrams for describing operations of the display device 100A.

As the process is further advanced, for the pixels with which rewriting has started earlier (i.e., the pixels P11, P12, P21, P22, P33, P34, P43 and P44), the values of the memory region Fij become to be 1 as shown in FIG. 49. As the process is advanced from the state shown in FIG. 49 up to a point where a judgment YES is made in step SC9 with i=1, the contents of the memory regions F11 and F12 become to be 0. As the process in step SC11 is executed, hatched portions in the image A in FIG. 50 are specified as portions where power is consumed. The controller 2 stores the number of the specified portions "4" in the memory region 2. Here, the contents of the boundary number memory region 8B assume a state wherein the contents of the memory region G1 and the memory region G2 are changed as shown in FIG. 50.

Figure 51:
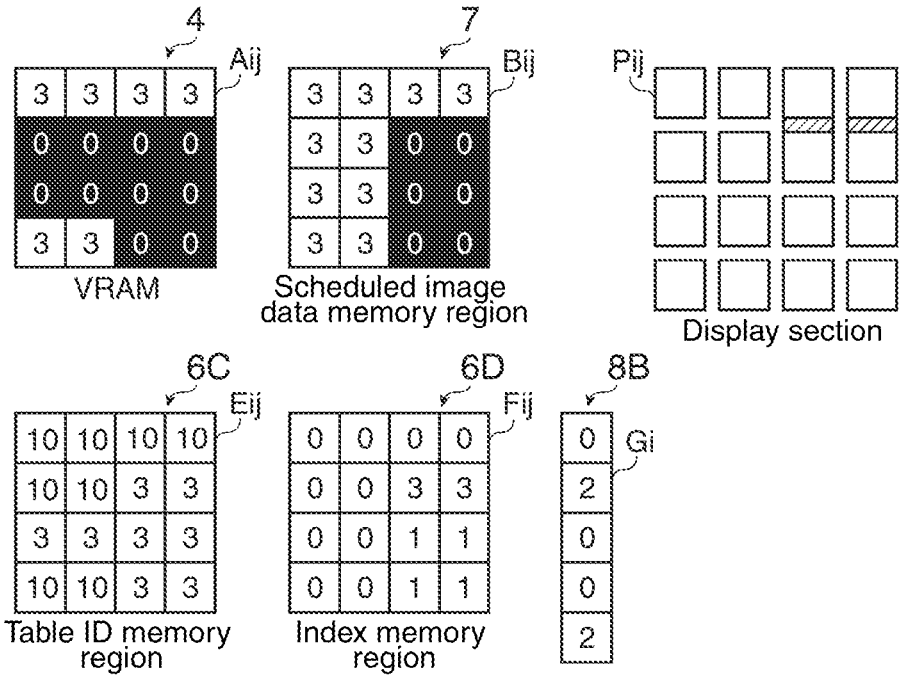
FIG. 51 shows diagrams for describing operations of the display device 100A.

The sum of the values stored in the boundary number memory region 8B is 8 at this moment, such that a judgment NO is made in step SC12, and the process proceeds to step SA4. Next, as the process is advanced from the state shown in FIG. 50 up to a point where a judgment YES is made in step SC9 with i=2, the contents of the memory regions F21 and F22 become to be 0. As the process in step SC11 is executed, hatched portions in the display section in FIG. 51 are specified as portions where power is consumed. Here, the contents of the boundary number memory region 8B assume a state wherein the contents of the memory region G2 and the memory region G3 are changed as shown in FIG. 51.

Figure 52:
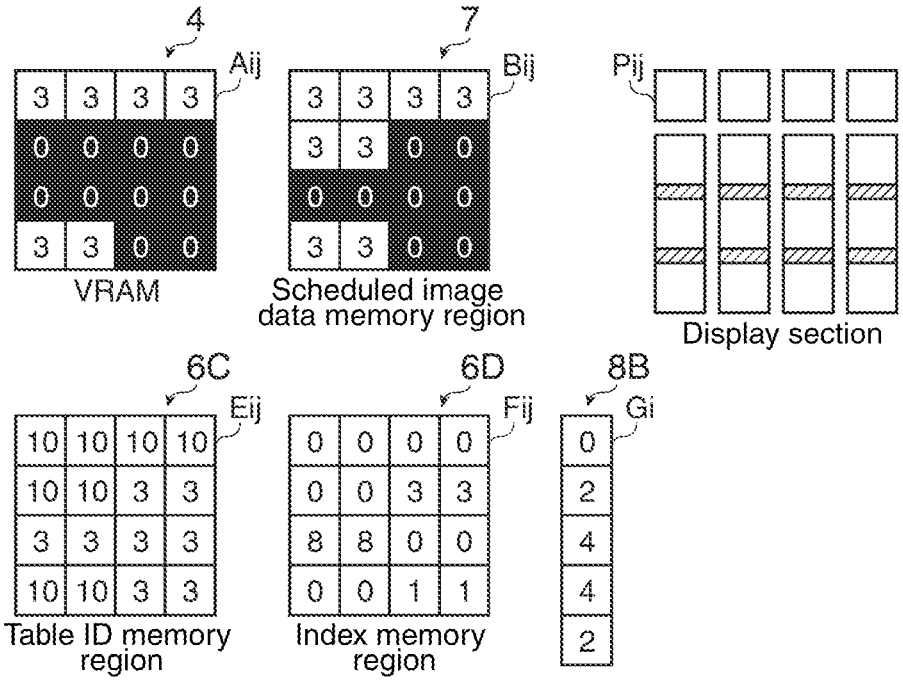
FIG. 52 shows diagrams for describing operations of the display device 100A.

The sum of the values stored in the boundary number memory region 8B is 4 at this moment, such that a judgment NO is made in step SC12, and the process proceeds to step SA4. Next, as the process is advanced from the state shown in FIG. 51 up to a point where a judgment YES is made in step SC9 with i=3, the contents of the memory regions F31 and F32 become to be 8, and the contents of the memory regions F33 and F34 become to be 0. As the process in step SC11 is executed, hatched portions in the display section in FIG. 52 are specified as portions where power is consumed, and the contents of the memory region G3 and the memory region G4 assume a state shown in FIG. 52.

Figure 53:
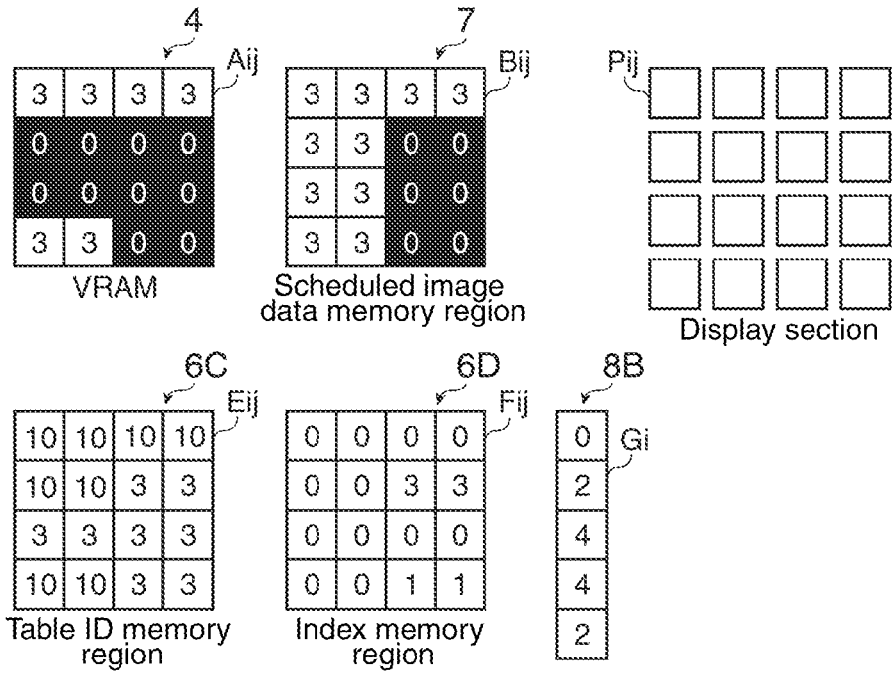
FIG. 53 shows diagrams for describing operations of the display device 100A.

Here, the sum of the values stored in the boundary number memory region 8B is greater than 10, such that a judgment YES is made in step SC12, and the process in step SC13 is executed whereby the contents of the memory regions assume a state shown in FIG. 53.

Figure 54:
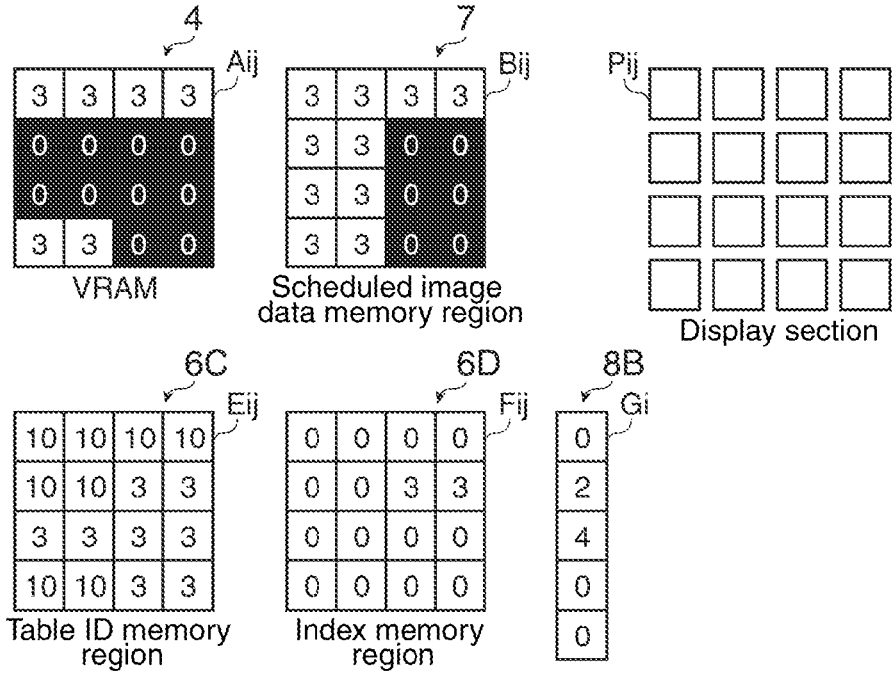
FIG. 54 shows diagrams for describing operations of the display device 100A.

Thereafter, the process proceeds to step SA4, and then the process is advanced with i=4. As the process is advanced from the state shown in FIG. 53 up to a point where a judgment YES is made in step SC9, the contents of the memory regions F43 and F44 become to be 0. Here, the process in step SC11 is executed. As the contents of the memory regions C41-C44 and the memory regions D41-D44 are 0, no portion with which application voltage is different from the adjacent row is specified, such that the contents of the memory regions G4 and G5 both become 0, and the contents of the memory regions assume a state shown in FIG. 54.

Figure 55:
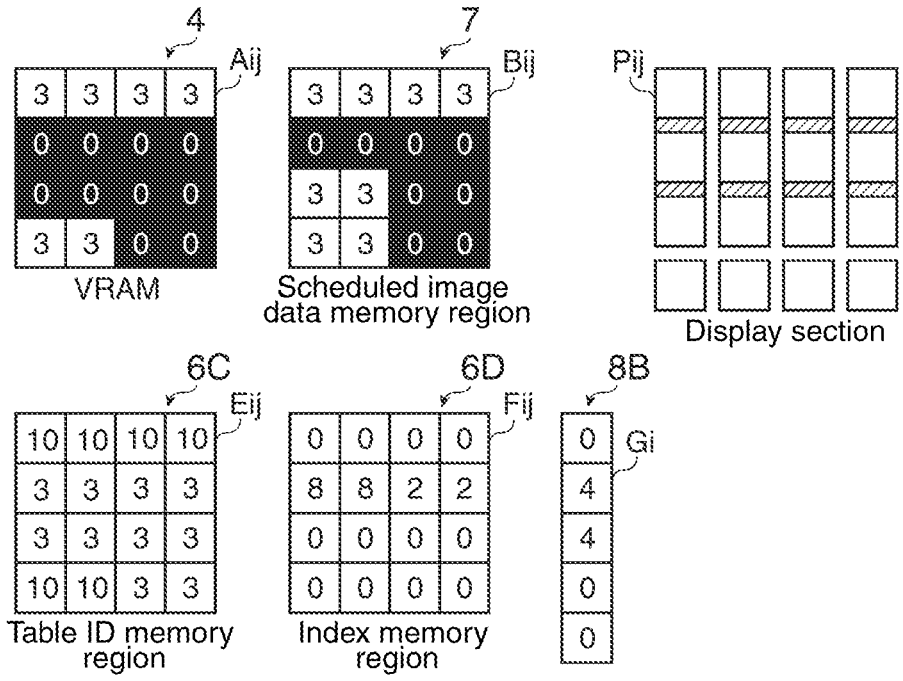
FIG. 55 shows diagrams for describing operations of the display device 100A.

Thereafter, the process proceeds to step SA4. As the process is advanced again with i=2, up to a point where a judgment YES is made in step SC9, the contents of the memory regions assume a state shown in FIG. 55. Here, as the process in step SC11 is executed, hatched portions in the display section in FIG. 55 are specified as portions where power is consumed, and the contents of the memory regions G2 and G3 assume a state shown in FIG. 55. Here, as the total of the values stored in the boundary number memory region 8B is less than 10, it is judged as NO in step SC12.

Figure 56:
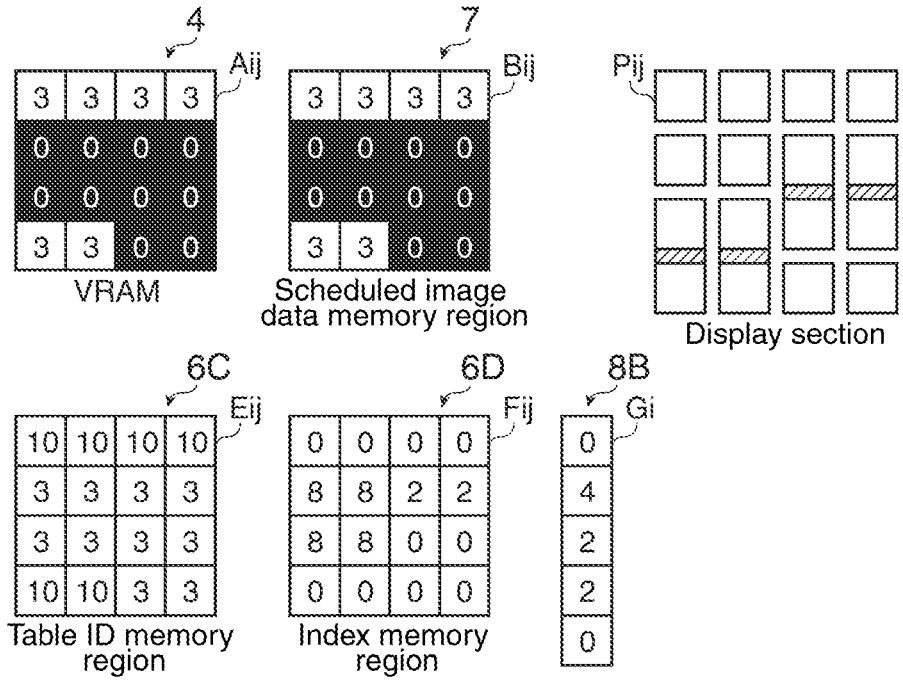
FIG. 56 shows diagrams for describing operations of the display device 100A.

As the process is advanced from the state shown in FIG. 55 up to a point where a judgment YES is made in step SC9 when i=3, the contents of the memory regions F31 and F32 become 8, as shown in FIG. 56. Here, as the process in step SC11 is executed, hatched portions of the display section in FIG. 56 are specified as portions where power is consumed, and the contents of the memory regions G3 and G4 assume a state shown in FIG. 56. Here, as the table IDs and the indexes are written to the corresponding memory regions for the pixels whose rewriting has been postponed, a change in the display state is started for the pixels whose rewriting has been postponed.

According to the present embodiment, even when a region where rewiring was started earlier and a region where rewriting is to be newly started overlap each other, rewiring is immediately started on a portion where rewiring is not in progress when the rewiring is newly started, which makes the user feel that the display speed is faster. Also, if rewriting of pixels would cause the peak value of the power consumption to exceed the amount of power that can be supplied by the power supply circuit, rewriting of the pixels is postponed. When the peak value of the power consumption assumes a level not to exceed the amount of power that can be supplied by the power supply circuit, rewriting of the pixels whose rewriting has been postponed is resumed, such that the peak value of the power consumption at the time of rewriting pixels can be suppressed.

Electronic Apparatus

Figure 57A:
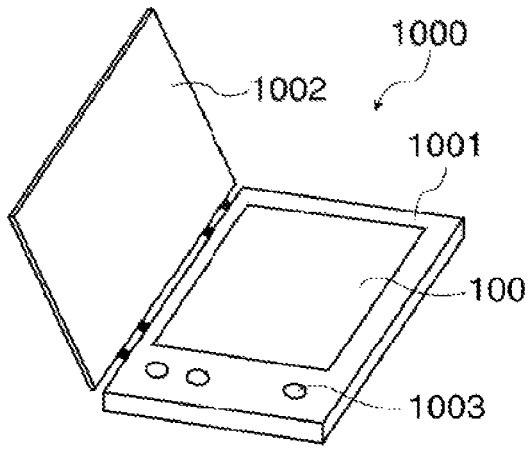
FIGS. 57A and 57B are perspective views showing application examples of a display device in accordance with embodiments of the invention.
Figure 57B:
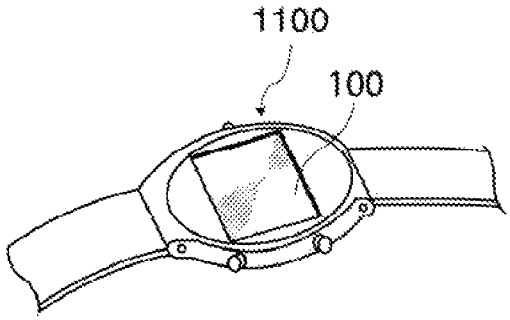

Next, electronic apparatuses using the display device in accordance with any one of the above-described embodiments will be described. FIG. 57A is a perspective view of an electronic book reader 1000 that uses a display device in accordance with the embodiment described above. The electronic book reader 1000 is provided with a book-shaped frame 1001, a cover 1002 that can be freely opened and closed with respect to the frame 1001, an operation portion 1003, and the display device 100 in accordance with an embodiment of the invention. The electronic book reader 1000 is configured such that contents of an electronic book are displayed on the display device 100, and pages of the electronic book are turned by operating the operation section 1003. Also, FIG. 57B is a perspective view of a wrist watch 1100 using the display device in accordance with the above-described embodiment. The wrist watch 1100 is provided with the display device 100 in accordance with the embodiment of the invention. The wrist watch 1100 is configured such that time, year, month, day, etc. are displayed on the display device 100. In addition to the above, the display device 100 in accordance with the above-described embodiment is applicable to other electronic apparatuses, such as, an electronic paper, an electronic notebook, an electronic calculator, a portable telephone, and the like.

Modification Examples

Some embodiments of the invention are described above. However, the invention is not limited to the embodiments described above, and various changes can be implemented. For example, the invention can be implemented by changing the above-described embodiments in manners described below. It is noted that each of the embodiments described above and each of the following modification examples may be combined.

Modification Example 1

In the embodiments described above, it is judged at each row of pixels as to whether or not the peak value of the power consumption would exceed the amount of power that can be supplied by the power supply circuit if rewriting of the pixels is newly started. However, the embodiment can be configured such that, if it is judged at a certain row that the peak value of the power consumption would exceed the amount of power that can be supplied by the power supply circuit, new rewriting of pixels after the row may be postponed.

Modification Example 2

In the embodiments described above, the operation is described using an example in which the display section 1 has pixels arranged in 4 rows and 4 columns. However, the pixels are not limited to the arrangement described above, and may be arranged in 400 rows and 640 columns, and the threshold value in step SB11 and step SC12 may be set to a value other than 10. If the pixels are arranged in several ten rows to several hundred rows, the pixels of the display section 1 may be divided into a plurality of regions in the unit of predetermined several rows to several ten rows. Also, a threshold value may be set for each of the divided regions, and the process concerning FIGS. 6 and 7 in accordance with the first embodiment described above or the process concerning FIG. 36 in accordance with the second embodiment described above may be executed for each of the regions. When the pixels of the display section 1 are not divided into multiple regions, there is a higher possibility to postpone rewriting for those of the pixels with greater row numbers, such that the timing to start rewriting them would likely be delayed. On the other hand, by the configuration in which the pixels of the display section 1 are divided into multiple regions, there is a higher possibility to start rewriting for those of the pixels with smaller row numbers in each of the regions, which would appear to the user that rewiring is started across the entire screen.

Modification Example 3

In the second embodiment described above, a voltage to be applied to the pixel electrode 13*a* may be specified based on a table ID and an index for a pixel in the i-th row whose display state is being updated and its adjacent pixel in the (i−1)-th row whose display state is being updated. When there is a potential difference of 30V between voltages applied to the pixel in the i-th row and the pixel in the (i−1)-th row adjacent to the pixel in the i-th row, update of the display state of the pixel in the i-th row may be stopped until its application voltage becomes equal to the voltage applied to the pixel in the (i−1)-th row.

Also, in accordance with the second embodiment, boundary portions that consume power are calculated at each frame. Instead, boundaries that consume power may be calculated initially for the entire frames based on table IDs and indexes. As a result of the calculation, if the sum of values stored in the boundary number memory region 8B for each of the frames is smaller than a predetermined value, the display operation may be executed without postponing rewriting in any of the rows in the entire frames. On the other hand, as a result of the calculation, if the sum of values stored in the boundary number memory region 8B becomes equal to or greater than a predetermined value in any one of the frames, the display operation may not be started, rewriting for rows after a specified row may be postponed until the second frame or thereafter, and the calculation is conducted for the entire frames again. Such an operation may be repeated, and the specified row is left until later by a specified number of frames. When the sum of values stored in the boundary number memory region 8B becomes smaller than the predetermined threshold value for the entire frames, the display operation may be started. By this operation, no matter how table IDs and indexes are distributed, it is possible to prevent a failure in which the power exceeds the limited value during the rewriting operation.

Furthermore, in accordance with the second embodiment, for adjacent pixels in adjacent rows, voltages to be applied to the respective pixels are specified based on the table ID memory region 6C and the index memory region 6D, and boundary portions that consume power are specified based on information of the voltages. However, instead of the above, if at least one of the table ID or the index is different between adjacent pixels in adjacent rows, the specified process may be conducted, assuming the boundary between these adjacent pixels as a boundary portion that consume power, Modification Example 4

In the embodiments described above, black electrophoretic particles are positively charged, and white electrophoretic particles are negatively charged. However, in accordance with another embodiment, black electrophoretic particles may be negatively charged, and white electrophoretic particles may be positively charged. Also, two types of electrophoretic particles, white and black electrophoretic particles are used to display black and white. However, the colors of the electrophoretic particles are not limited to black and white, but the electrophoretic particles may be in other colors such as red, blue, green and the like.

Also, in accordance with the embodiments described above, the display device 100 uses an electrophoretic system, but is not limited to electrophoretic systems. The display device 100 may use any one of display systems which display an image by applying voltages to pixels through a plurality of frames, such as, for example, a system using cholesteric liquid crystal, electrochromic material, electronic particles or the like. The electrophoretic layer 20 is not limited to a configuration having microcapsules 21, but may have a configuration in which dispersion medium and electrophoretic particles are stored in spaces divided by partition walls. Also, in the embodiments described above, the controller 2 and the control section 3 are provided independently. However, a part of the functions realized b the controller 2 may be achieved by the control section 3, or the controller 2 and the control section 3 may be integrated together on a single semiconductor chip as a control section.

The entire disclosure of Japanese Patent Application No. 2010-203619, filed Sep. 10, 2010 is expressly incorporated by reference herein.

What is claimed is:

1. A control device for a display device that includes pixels in a plurality of rows and a plurality of columns, a first substrate having first electrodes each provided for each of the pixels, a second substrate having a second electrode, and display elements sandwiched between the first substrate and the second substrate, each of the pixels including the first electrode, the display element and the second electrode, and changes a display state of the pixel from a first display state to a second display state by a write operation of applying a voltage to the display element a plurality of times, the control device comprising:

a selection section that sequentially selects the rows;

a data read section that reads image data of an image to be displayed on the display device from a memory;

a specifying section that specifies, based on scheduled image data representative of an image scheduled to be displayed on the display device before the data read section reads image data and the image data read by the data read section, changing pixels whose display state is to be newly changed among pixels in a row selected by the selection section;

a boundary specifying section that specifies pixels among the pixels in the row selected by the selection section which are to be impressed with a voltage different from a voltage applied to pixels in an adjacent row, and specifies boundaries between the specified pixels and the pixels in the row adjacent to the specified pixels which are impressed with a voltage different from a voltage applied to the specified pixels;

a boundary number memory section that stores a boundary number of the boundaries specified by the boundary specifying section at each of the rows;

a judging section that judges as to whether or not the sum of the boundary numbers stored in the boundary number memory section is equal to or greater than a predetermined threshold value; and an update section that, when the judging section judges that the sum is less than the predetermined threshold value, starts the write operation with respect to the changing pixels to be changed to a display state defined by the image data if the changing pixels in the row selected by the selection section are not in the write operation, and starts the write operation with respect to the changing pixels to be changed to the display state defined by the image data after the ongoing write operation is finished if the changing pixels are in the write operation, and that, when the judging section judges that the sum is equal to or greater than the predetermined threshold value, does not start the write operation with respect to the changing pixels until the judging section judges that the sum is less than the threshold value.

2. A control device according to claim 1, wherein the pixels in a plurality of rows and a plurality of columns are divided into a plurality of regions each having a predetermined number of rows, and the judging section judges as to whether or not the sum of the boundary numbers concerning the region including the row selected by the selection section is equal to or greater than the predetermined threshold value.

3. A control device according to claim 1, wherein voltages are applied to the pixels according to a table that sets voltages to be applied in each of the plurality of times of voltage application.

4. A control device according to claim 3, wherein the voltage application timing is controlled such that a pixel among the pixels in the row selected by the selection section with which the writing operation is in progress is impressed with the same voltage as a voltage applied to a pixel in an adjacent row with which the writing operation is in progress.

5. A display device that includes pixels in a plurality of rows and a plurality of columns, a first substrate having first electrodes each provided for each of the pixels, a second substrate having a second electrode, and display elements sandwiched between the first substrate and the second substrate, each of the pixels including the first electrode, the display element and the second electrode, and changes the display state of the pixel from a first display state to a second display state by a write operation of applying a voltage to the display element a plurality of times, the display device comprising:

a selection section that sequentially selects the rows;

a data read section that reads image data of an image to be displayed on the display device from a memory;

a specifying section that specifies, based on scheduled image data representative of an image scheduled to be displayed on the display device before the data read section reads image data and the image data read by the data read section, changing pixels whose display state is to be newly changed among pixels in a row selected by the selection section;

a boundary specifying section that specifies pixels among the pixels in the row selected by the selection section which are to be impressed with a voltage different from a voltage applied to pixels in an adjacent row, and specifies boundaries between the specified pixels and the pixels in the row adjacent to the specified pixels which are impressed with a voltage different from a voltage applied to the specified pixels;

a boundary number memory section that stores a boundary number of the boundaries specified by the boundary specifying section at each of the rows;

a judging section that judges as to whether or not the sum of the boundary numbers stored in the boundary number memory section is equal to or greater than a predetermined threshold value; and an update section that, when the judging section judges that the sum is less than the predetermined threshold value, starts the write operation with respect to the changing pixels to be changed to a display state defined by the image data if the changing pixels in the row selected by the selection section are not in the write operation, and starts the write operation with respect to the changing pixels to be changed to the display state defined by the image data after the ongoing write operation is finished if the changing pixels are in the write operation, and that, when the judging section judges that the sum is equal to or greater than the predetermined threshold value, does not start the write operation with respect to the changing pixels until the judging section judges that the sum is less than the threshold value.

6. A method for controlling a display device that includes pixels in a plurality of rows and a plurality of columns, a first substrate having first electrodes each provided for each of the pixels, a second substrate having a second electrode, and display elements held between the first substrate and the second substrate, each of the pixels including the first electrode, the display element and the second electrode, and the method includes changing the display state of the pixel from a first display state to a second display state by a write operation of applying a voltage to the display element a plurality of times, the method comprising:

a selection step of sequentially selecting the rows;

a data read step of reading image data of an image to be displayed on the display device from a memory;

a specifying step of specifying, based on scheduled image data representative of an image scheduled to be displayed on the display device before the data read step reads image data and the image data read by the data read step, changing pixels whose display state is to be newly changed among pixels in a row selected by the selection step;

a boundary specifying step of specifying pixels among the pixels in the row selected by the selection step which are to be impressed with a voltage different from a voltage applied to pixels in an adjacent row, and specifies boundaries between the specified pixels and the pixels in the row adjacent to the specified pixels which are impressed with a voltage different from a voltage applied to the specified pixels;

a boundary number memory step of storing a boundary number of the boundaries specified by the boundary specifying step at each of the rows;

a judging step of judging as to whether or not the sum of the boundary numbers stored in the boundary number memory section is equal to or greater than a predetermined threshold value; and an update step of, when the judging step judges that the sum is less than the predetermined threshold value, starting the write operation with respect to the changing pixels to be changed to a display state defined by the image data if the changing pixels in the row selected by the selection step are not in the write operation, and starting the write operation with respect to the changing pixels to be changed to the display state defined by the image data after the ongoing write operation is finished if the changing pixels are in the write operation; and, when the judging step judges that the sum is equal to or greater than the predetermined threshold value, not starting the write operation with respect to the changing pixels until the judging step judges that the sum is less than the threshold value.

* * * * *